US008516648B2

(12) United States Patent
Sakashita et al.

(10) Patent No.: US 8,516,648 B2
(45) Date of Patent: Aug. 27, 2013

(54) INDOOR UNIT OF AIR CONDITIONER

(75) Inventors: Akihiko Sakashita, Osaka (JP); Yoshiharu Michitsuji, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 392 days.

(21) Appl. No.: 12/812,210

(22) PCT Filed: Jan. 8, 2009

(86) PCT No.: PCT/JP2009/000045

§ 371 (c)(1),
(2), (4) Date: Jul. 8, 2010

(87) PCT Pub. No.: WO2009/087969

PCT Pub. Date: Jul. 16, 2009

(65) Prior Publication Data

US 2010/0281649 A1 Nov. 11, 2010

(30) Foreign Application Priority Data

Jan. 9, 2008 (JP) ..... 2008-002256
Jan. 25, 2008 (JP) ..... 2008-015639

(51) Int. Cl.
*F24F 1/00* (2011.01)
*F24F 13/28* (2006.01)

(52) U.S. Cl.
USPC ..... 15/301; 15/328; 15/352; 623/303; 454/292; 454/251; 55/295; 55/296

(58) Field of Classification Search
USPC ..... 15/301, 352; 62/303, 426, 408, 62/428, 429; 454/292, 256, 254, 251, 333; 55/289, 295, 296, 297, 283, 428, 429
See application file for complete search history.

(56) References Cited

U.S. PATENT DOCUMENTS

| | | | | |
|---|---|---|---|---|
| 2,405,129 | A * | 8/1946 | Bible | 55/296 |
| 2007/0060036 | A1* | 3/2007 | Shibuya et al. | 454/187 |
| 2008/0006155 | A1* | 1/2008 | Sellers et al. | 95/282 |
| 2008/0223062 | A1 | 9/2008 | Yabu et al. | |

FOREIGN PATENT DOCUMENTS

| | | | |
|---|---|---|---|
| CN | 1754070 | A | 3/2006 |
| JP | 2002-357398 | A | 12/2002 |
| JP | 2005-83612 | A | 3/2005 |
| JP | 2005-83721 | A | 3/2005 |
| JP | 2005-308274 | A | 11/2005 |

(Continued)

OTHER PUBLICATIONS

WO2007060920A1 (machine translation), 2007.*

*Primary Examiner* — Mark Spisich
*Assistant Examiner* — Andrew A Horton
(74) *Attorney, Agent, or Firm* — Birch, Stewart, Kolasch & Birch, LLP.

(57) ABSTRACT

An indoor unit of an air conditioner having an air filter provided on a suction side of an indoor fan has a construction in which dust removed from the air filter by a dust removing part can be recovered easily and reliably. The construction includes a dust removing part (51) for removing dust captured by an air filter (30) provided on the suction side of an indoor fan (21), storage containers (60), (81) having the dust removing part (51) stored therein, a nozzle insertion part (110) into which a nozzle (150) of a cleaner can be inserted, and a suction passage (95) for making the storage containers (60), (81) to communicate with the nozzle insertion part (110).

7 Claims, 21 Drawing Sheets

(56) References Cited

FOREIGN PATENT DOCUMENTS

| | | | |
|---|---|---|---|
| JP | 2006-214663 | A | 8/2006 |
| JP | 2007-147141 | A | 6/2007 |
| JP | 2007-315626 | A | 12/2007 |
| WO | 2004/079270 | A1 | 9/2004 |
| WO | WO 2005/026623 | A1 | 3/2005 |
| WO | WO 2007060920 | A1 * | 5/2007 |

* cited by examiner (A)

(B)

(C)

(A)

(B)

(A)

(B)

INDOOR UNIT OF AIR CONDITIONER

TECHNICAL FIELD

The present invention relates to an indoor unit of an air conditioner constructed in such a way that dust captured by an air filter is removed.

BACKGROUND ART

In an air conditioner having an air filter provided at a suction port of air, there has been known an indoor unit provided with a dust removing part for removing dust captured by the air filter. As for an indoor unit of this kind, there have been known an indoor unit constructed in such a way that dust attached to an air filter is sucked by a suction nozzle as a dust removing part and an indoor unit constructed in such a way that dust is scraped off by a brush part as a dust removing part, as disclosed in, for example, a patent document 1.

In the constructions, in both cases, constituent parts of a heat exchanger, an indoor fan, and the like are arranged in a box-shaped casing, and an air filter, a dust removing part, and the like are arranged at the suction port of the indoor fan. In this regard, the indoor side of the casing is covered with an indoor panel.

CITATION LIST

Patent Document

PATENT DOCUMENT 1: Japanese Patent Publication No. 2005-83612

SUMMARY OF THE INVENTION

Technical Problem

In the meantime, in the construction of the prior art having a dust removing part for removing dust attached to an air filter, the dust removed by the dust removing part needs to be recovered. As a method for recovering dust can be thought a method for capturing and recovering dust removed from the air filter in a container. However, in the case of a cassette-type indoor unit arranged on a ceiling, the work of dismounting the container from the indoor unit arranged on the ceiling and the work of recovering the dust from the container put a heavy burden on a user.

The present invention has been made in view of such a point, and the object of the present invention is to provide a construction capable of easily and reliably recovering dust removed from an air filter by a dust removing part in an indoor unit of an air conditioner having an air filter provided on a suction side of an indoor fan.

Solution to the Problem

In order to achieve the object, in an indoor unit (3) of an air conditioner (1) according to the present invention, storage containers (60), (81) in which dust removing parts (51), (52) for removing dust captured by an air filter (30) are stored and a nozzle connection part (121) on which a nozzle (150) of a cleaner contacts are made to communicate with each other through a suction passage (95), whereby the dust can be sucked and recovered by the nozzle (150) of the cleaner.

Specifically, a first invention is intended for an indoor unit of an air conditioner in which an indoor heat exchanger (22), an indoor fan (21) for blowing off air sucked from inside a room to the inside of the room, and an air filter (30) provided on a suction side of the indoor fan (21) are provided in casings (18), (101).

The indoor unit (3) of an air conditioner (1) of the first invention includes: the dust removing parts (51), (52) for removing dust captured by the air filter (30); storage containers (60), (81) having the dust removing parts (51), (52) stored therein; a nozzle connection part (121) on which the nozzle (150) of the cleaner contacts; and a suction passage (95) for making the storage containers (60), (81) to communicate with the nozzle connection part (121).

With this construction, the dust captured by the air filter (30) is removed by the dust removing parts (51), (52) and then is sucked and recovered by the nozzle (150) of the cleaner through the suction passage (95) for making the dust removing parts (51), (52) to communicate with the nozzle connection part (121) on which the nozzle (150) of the cleaner contacts. This can eliminate the need for going up to a ceiling and recovering the dust removed from the air filter (30) and can make it possible to recover the dust easily by the nozzle (150) of the cleaner. Thus, it is possible to improve workability at the time of recovering the dust.

In addition, the suction passage (95) is connected to the storage containers (60), (81) having the dust removing parts (51), (52) stored therein, so that the dust in the storage containers (60), (81) can be sucked efficiently and reliably by the nozzle (150) of the cleaner.

In the construction, the indoor unit (3) of an air conditioner (1) further includes: a dust capturing part (90) for capturing the dust in the storage containers (60), (81); and a dust carrying device (80) for carrying the dust in the storage containers (60), (81) to the dust capturing part (90) (second invention).

In this way, the dust removed from the air filter (30) by the dust removing parts (51), (52) is carried to the dust capturing part (90) by the dust carrying device (80) and is stored there. Thus, it is possible to reduce the frequency at which the dust is recovered.

Further, it is preferable that the dust carrying device (80) is provided with a dust carrying passage (96) for making the storage containers (60), (81) to communicate with the dust capturing part (90), the dust carrying passage (96) communicating with the storage containers (60), (81) at an end part opposite to a communication part in which the suction passage (95) communicates with the storage containers (60), (81) (third invention).

In this way, when the dust is sucked and recovered by the nozzle (150) of the cleaner through the suction passage (95), not only the dust captured in the dust capturing part (90) but also the dust in the storage containers (60), (81) can be recovered. In other words, the dust carrying passage (96) connecting with the dust capturing part (90) is made to communicate with the storage containers (60), (81) at the end part opposite to the communication part in which the suction passage (95) communicates with the storage containers (60), (81), whereby air is made to flow from the dust capturing part (90) to the dust carrying passage (96), the storage containers (60), (81), and the suction passage (95) by the suction of the nozzle of the cleaner. Thus, it is possible to reliably recover the dust stored or packed in the storage containers (60), (81).

Still further, it is preferable that the dust carrying device (80) is constructed in such a way as to carry the dust to the dust capturing part (90) by utilizing of air blown off from the indoor fan (21) and is provided with a blown-off air passage (89) for making a blowoff side of the indoor fan (21) to communicate with the storage containers (60), (81), the blown-off air passage (89) being provided in such a way as to communicate with the storage containers (60), (81) at an end part opposite to a communication part in which the dust carrying passage (96) communicates with the storage containers (60), (81) (fourth invention).

In this way, the use of the air blown off from the indoor fan (21) makes it possible to carry the dust reliably by a simple construction. In addition, the blown-off air passage (89) for making the blowoff side of the indoor fan (21) to communicate with the storage containers (60), (81) is provided in such a way as to communicate with the storage containers (60), (81) on the opposite side of the communication part in which the dust carrying passage (96) communicates with the storage containers (60), (81). Thus, it is possible to make the air blown off from the indoor fan (21) flow smoothly to the dust capturing part (90) via the storage containers (60), (81) and hence to reliably carry the dust in the storage containers (60), (81) to the dust capturing part (90). Therefore, it is possible to efficiently capture the dust removed from the air filter (30) in the dust capturing part (90) by the construction.

Still further, it is preferable that the indoor unit (3) of an air conditioner (1) further includes a channel switching device (82) capable of switching a flow channel of air in the storage containers (60), (81) between a carrying channel in which air flows from the blown-off air passage (89) to the dust carrying passage (96) and a suction channel in which air flows from the dust carrying passage (96) to the suction passage (95) (fifth invention).

In this way, the flow channel of the dust can be switched between the carrying channel and the suction channel, so that when the dust in the storage containers (60), (81) and in the dust capturing part (90) is recovered through the suction passage (95), it is possible to prevent the effect of air blown off from the indoor fan (21) and hence to recover the dust efficiently. In other words, the flow of air when the dust is carried into the dust capturing part (90) and the flow of air when the dust is sucked and recovered from the dust capturing part (90) are made opposite to each other in the dust carrying passage (96) and the storage containers (60), (81). Thus, the switching of the flow channel of air by the channel switching device (82) can prevent the flow of air from being inhibited in the respective channels.

Still further, it is preferable that the storage containers (60), (81) have a connection passage part (81) to which the blown-off air passage (89) and the suction passage (95) are connected and that the channel switching device (82) is provided between a communication part in which the blown-off air passage (89) communicates with the connection passage part (81) and a communication part in which the suction passage (95) communicates with the connection passage part (81) (sixth invention).

In this way, it is possible to realize the construction of the fifth invention for switching the flow of air in the storage containers (60), (81) between the carrying channel and the suction channel.

Moreover, in the construction, it is preferable that a suction duct (87) constructing the suction passage (95) is connected to the storage containers (60), (81) rotatably about an axis of a connection portion in which the suction duct (87) is connected to the storage containers (60), (81) (seventh invention).

In this way, the suction duct (87) can be turned with respect to the storage containers (60), (81), which can improve the degree of freedom of layout of the suction duct (87). Thus, even if the layout of the nozzle connection part (121) is changed (for example, when the direction of the suction grill is changed), the suction duct (87) is turned in response to the change in layout to thereby connect the storage containers (60), (81) reliably to the nozzle connection part (121) by the suction duct (87).

Still further, it is preferable that an indoor side panel (11) for covering indoor sides of the casings (18), (101) is provided with a nozzle insertion part (110) into which the nozzle (150) of the cleaner can be inserted and that the nozzle connection part (121) is provided in the nozzle insertion part (110) (eighth invention). Still further, it is preferable that the nozzle insertion part (110) is provided with an upper cover member (116) and a lower cover member (117) for covering the nozzle connection part (121) and that the upper cover member (116) has the suction passage (95) connected thereto and is configured to turn with respect to the lower cover member (117) (ninth invention).

In this way, in the nozzle insertion part (110) having the nozzle connection part (121) provided therein, the upper cover member (116) can turn with respect to the lower cover member (117), so that, for example, in the case where the direction of the suction grill is changed, that is, even in the case where the construction of the indoor side panel (11) is changed to change the positional relationship between the storage containers (60), (81) and the nozzle insertion part (110), the storage containers (60), (81) can be reliably connected to the nozzle connection part (121) by the suction nozzle (87). In addition, in the case of the construction in which the connection portion in which the suction duct (87) is connected to the storage containers (60), (81) can be turned, the storage containers (60), (81) can be connected to the nozzle connection part (121) at the shortest distance, which can make the suction duct (87) shorter.

Advantages of the Invention

As described above, according to the present invention, the storage containers (60), (81) in which the dust removing parts (51), (52) for removing dust captured by the air filter (30) are stored are made to communicate with the nozzle connection part (121) on which the nozzle (150) of the cleaner contacts by the suction passage (95). This makes it possible to suck and recover dust efficiently by the nozzle (150) of the cleaner and hence to improve the workability of a dust recovering work.

Further, according to the second invention, the indoor unit (3) of the air conditioner (1) further includes the dust capturing part (90) for capturing dust in the storage containers (60), (81) and the dust carrying device (80) for carrying the dust in the storage containers (60), (81) to the dust capturing part (90). This makes it possible to store the dust removed from the air filter (30) in the dust capturing part (90) by the dust carrying device (80) and hence to reduce the frequency at which the dust is recovered. Therefore, it is possible to further improve the workability of the dust recovering work.

Still further, according to the third invention, the dust carrying passage (96) of the dust carrying device (80) is provided in such a way as to communicate with the storage containers (60), (81) at the end part opposite to the communication part in which the suction passage (95) communicates with the storage containers (60), (81), so that when the dust is sucked and recovered through the suction passage (95), not only the dust captured in the dust capturing part (90) but also the dust in the storage containers (60), (81) can be recovered. Therefore, it is possible to improve the efficiency of recovering dust.

Still further, according to the fourth invention, the dust carrying device (80) is constructed in such a way as to carry dust by use of air blown off from the indoor fan (21) and the blown-off air passage (89) communicating with the blowoff side of the indoor fan (21) is provided in such a way as to communicate with the storage containers (60), (81) on the side opposite to the communication part in which the dust carrying passage (96) communicates with the storage containers (60), (81). This makes it possible to cause the blown-off air smoothly flow in the storage containers (60), (81) to thereby efficiently carry the dust in the storage containers (60), (81) to the dust capturing part (90). Therefore, it is possible to efficiently capture the dust into the dust capturing part (90).

Still further, according to the fifth invention, the indoor unit (3) of the air conditioner (1) further includes the channel switching device (82) capable of switching the flow channel of air in the storage containers (60), (81) between the carrying channel from the blown-off air passage (89) to the dust carrying passage (96) and the suction channel from the dust carrying passage (96) to the suction passage (95). This can prevent the flow of air from being inhibited in the respective channels. Therefore, it is possible to efficiently carry the dust at the time of carrying the dust and to efficiently suck and recover the dust at the time of recovering the dust.

Still further, according to the sixth invention, in the connection passage part (81) to which the blown-off air passage (89) and the suction passage (95) of the storage containers (60), (81) are connected, the channel switching device (82) is provided between the communication part in which the blown-off air passage (89) communicates with the connection passage part (81) and the communication part in which the suction passage (95) communicates with the connection passage part (81). This can realize the construction of the fifth invention.

Still further, according to the seventh invention, the suction duct (87) constructing the suction passage (95) is connected to the storage containers (60), (81) in such a way as to be able to turn around the axis of the connection portion of the suction duct (87). Thus, it is possible to improve the degree of freedom of layout of the suction duct (87) and to respond to also a change in the layout of the nozzle insertion part (110).

Still further, according to the eighth and the ninth inventions, the upper cover member (116) of the nozzle insertion part (110) provided with the nozzle connection part (121) is constructed in such a way as to have the suction passage (95) connected thereto and to be able to turn with respect to the lower cover member (117). Thus, it is possible to improve the degree of freedom of layout of the suction grill (12) and the like of the indoor side panel (11). In addition, when the upper cover member (116) is constructed in such a way that also the connection portion of the suction duct (87) can be turned, the length of the suction duct (87) can be made as short as possible.

DESCRIPTION OF EMBODIMENTS

Figure 1:
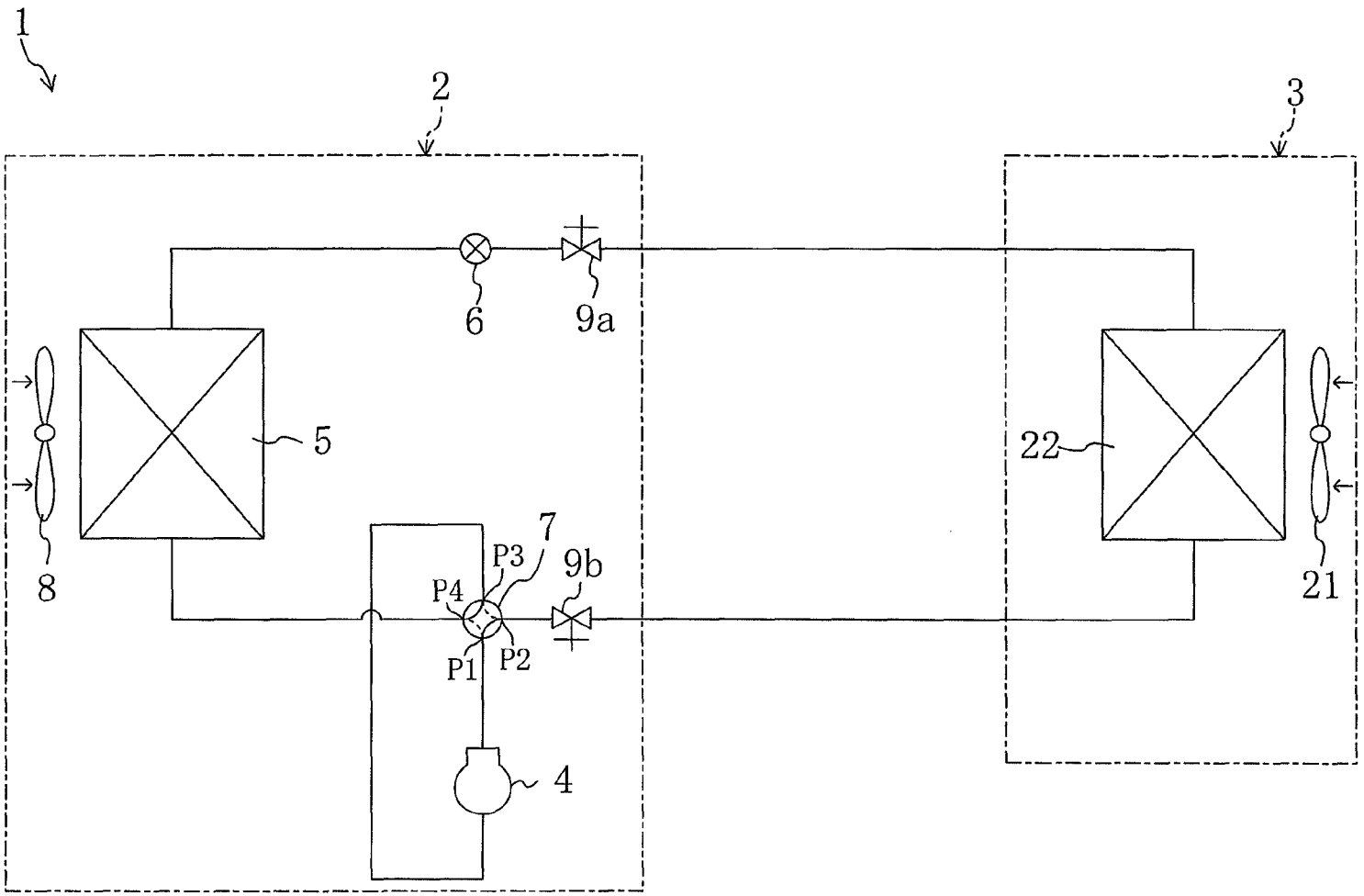
FIG. 1 is a piping system diagram to show a construction of an air conditioner provided with an indoor unit according to an embodiment of the present invention.

Embodiments of the present invention will be described in detail hereinafter referring to the drawings. In this regard, the description of the following preferable embodiments essentially provides only examples, and it is not intended to limit the invention, applications of the invention, and the use of the invention by the embodiments.

The present embodiment relates to an air conditioner (1) provided with an indoor unit (3) according to the present invention. In this air conditioner (1), the indoor unit (3) is placed on a ceiling of an indoor space. Here, first, the construction of the air conditioner (1) according to the present embodiment will be described below. Next, the construction of the indoor unit (3) will be described.

<General Construction>

As shown in FIG. 1, the air conditioner (1) is provided with an outdoor unit (2) and an indoor unit (3). The outdoor unit (2) is provided with a compressor (4), an outdoor heat exchanger (5), an expansion valve (6), a four way valve (7), and an outdoor fan (8). The indoor unit (3) is provided with an indoor heat exchanger (22) and an indoor fan (21).

In the outdoor unit (2), a discharge side of the compressor (4) is connected to a first port (P1) of the four way valve (7). A suction side of the compressor (4) is connected to a third port (P3) of the four way valve (7).

The outdoor heat exchanger (5) is constructed as a cross-fin type fin-and-tube heat exchanger. One end of the outdoor heat exchanger (5) is connected to a fourth port (P4) of the four way valve (7). The other end of the outdoor heat exchanger (5) is connected to a liquid-side closing valve (9*a*).

The outdoor fan (8) is arranged near the outdoor heat exchanger (5). In this outdoor heat exchanger (5), heat is exchanged between outdoor air sent by the outdoor fan (8) and refrigerant circulating in the outdoor heat exchanger (5). A variable expansion valve (6) is provided between the outdoor heat exchanger (5) and the liquid-side closing valve (9*a*). Moreover, a second port (P2) of the four way valve (7) is connected to a gas-side closing valve (9*b*).

The four way valve (7) can switch between a first state (state shown by solid lines in FIG. 1) in which the first port (P1) and the second port (P2) communicate with each other and in which the third port (P3) and the fourth port (P4) communicate with each other and a second state (state shown by broken lines in FIG. 1) in which the first port (P1) and the fourth port (P4) communicate with each other and in which the second port (P2) and the third port (P3) communicate with each other.

In this air conditioner (1), in the case where the four way valve (7) is set in the first state, a heating operation is performed, whereas in the case where the four way valve (7) is set in the second state, a cooling operation is performed. In the heating operation is performed a vapor compression refrigeration cycle in which in a refrigerant circuit shown in FIG. 1, the outdoor heat exchanger (5) functions as an evaporator whereas the indoor heat exchanger (22) functions as a condenser. On the other hand, in the cooling operation is performed a vapor compression refrigeration cycle in which in the refrigerant circuit shown in FIG. 1, the outdoor heat exchanger (5) functions as a condenser whereas the indoor heat exchanger (22) functions as an evaporator.

<Construction of Indoor Unit>

Hereinafter, a construction of the indoor unit (3) will be described in detail on the basis of FIG. 2 to FIG. 4.

Figure 2:
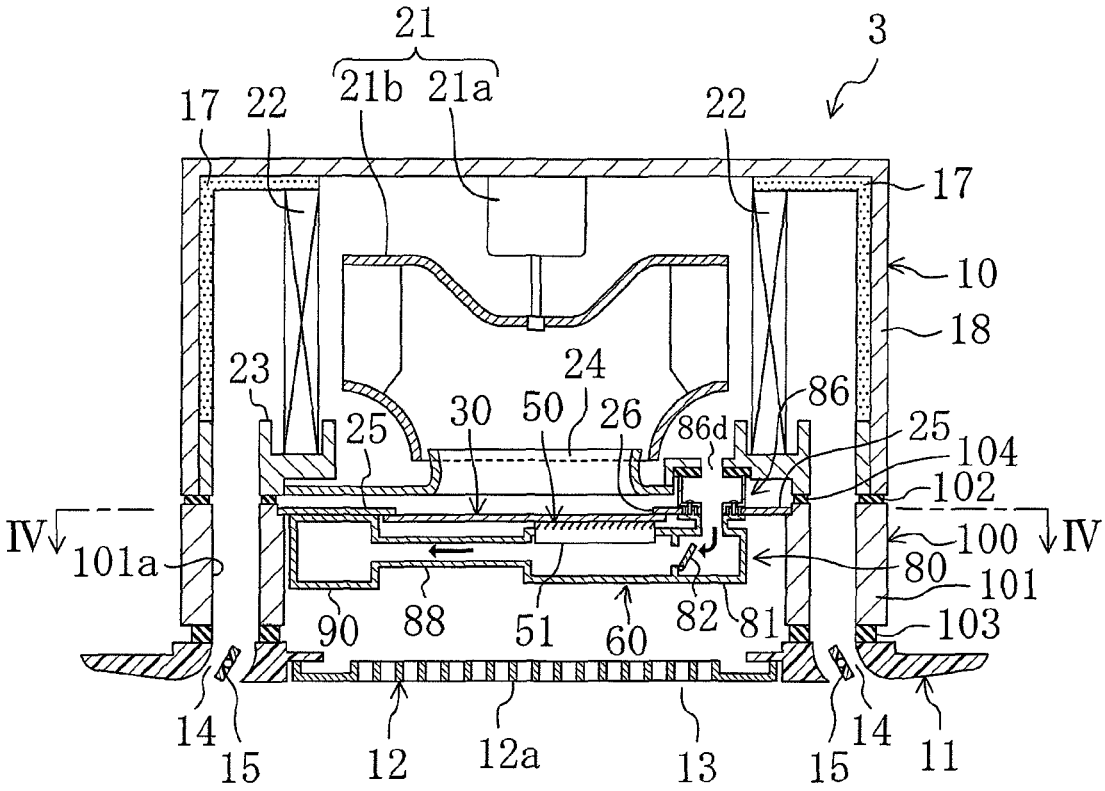
FIG. 2 is a longitudinal section view to show a construction of the interior of the indoor unit.
Figure 3:
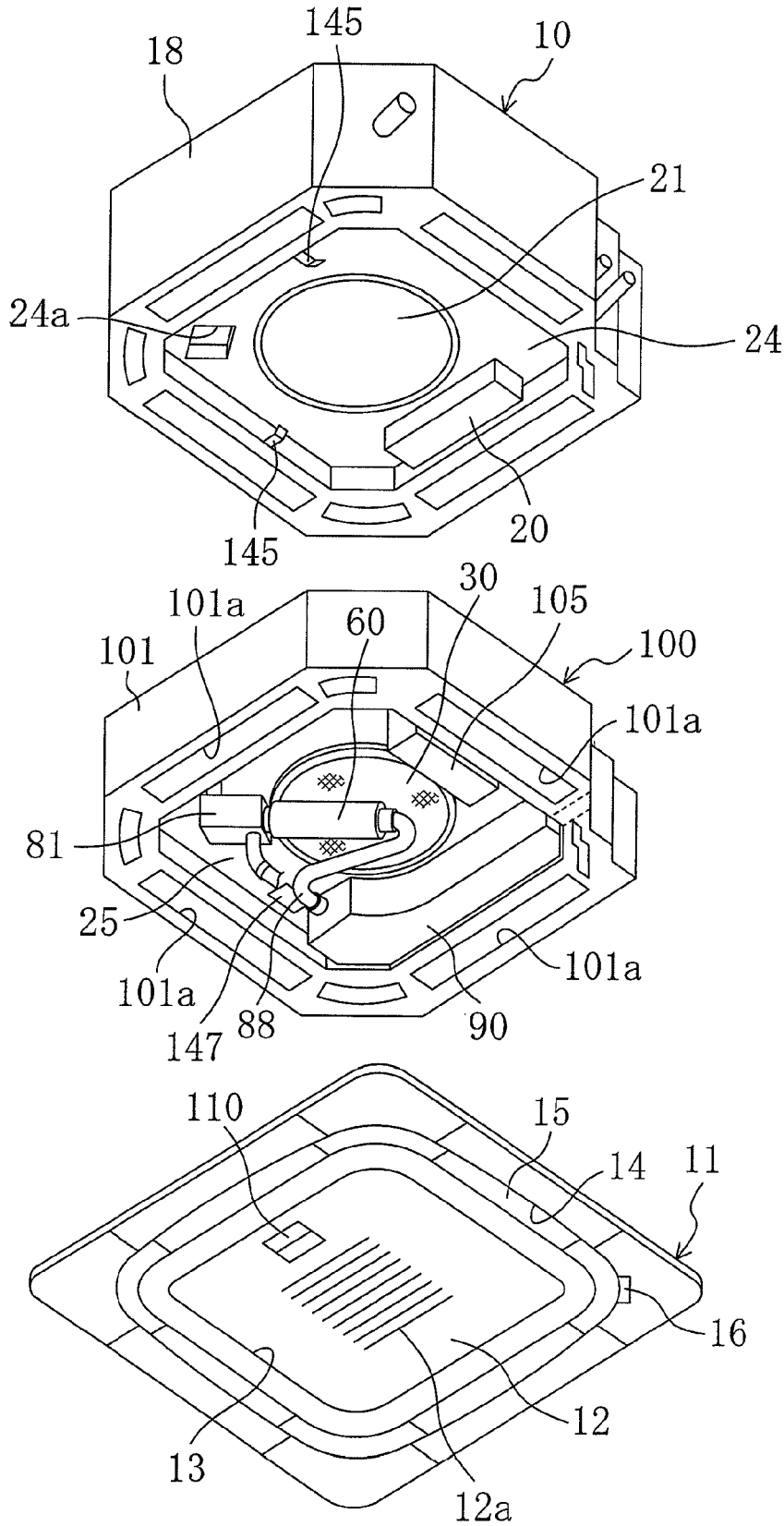
FIG. 3 is an exploded view in perspective to show a state in which the indoor unit is exploded into respective units.

As shown in FIG. 2 and FIG. 3, the indoor unit (3) is provided with: a main unit (10) provided with the indoor fan (21) and the indoor heat exchanger (22); a cleaning unit (100) arranged on the indoor side of the main unit (10); and a decorative panel (indoor-side panel) (11) for covering the indoor side of the cleaning unit (100). In other words, in the indoor unit (3), as shown in FIG. 3, beginning at the top, the main unit (10), the cleaning unit (100), and the decorative panel (11) are stacked.

The main unit (10) is provided with a box-shaped main casing (18) arranged in such a way as to be open to the inside of the room, and the main casing (18) has the indoor fan (21), the indoor heat exchanger (22), a drain pan (23), a bell mouth (24), and an electric component box (20) arranged therein. In this regard, in the present embodiment, an air flow partitioning plate for covering the lower side of the main casing (18) of the main unit (10) is constructed of a part of the drain pan (23) and a part of the bell mouth (24).

The main casing (18) has a heat insulating material (17) stacked on the inside surface thereof. Moreover, the main casing (18) is suspended from and held by the ceiling surface of the bottom of the ceiling in such a way that its open side is positioned inside the room, which will be described later.

The indoor fan (21) is a so-called turbo-fan. As described in FIG. 2, the indoor fan (21) is arranged near the center of the main casing (18) of the main unit (10) and is positioned above a suction port (13) of the decorative panel (11) that will be described later. The indoor fan (21) is provided with a fan motor (21*a*) and an impeller (21*b*). The fan motor (21*a*) is fixed to a ceiling plate of the main casing (18). The impeller (21*b*) is coupled to a rotary shaft of the fan motor (21*a*).

The bell mouth (24) is provided below the indoor fan (21) in such a way as to communicate with the suction port (13). This bell mouth (24), as shown in FIG. 2, partitions a space on the upstream side of the indoor heat exchanger (22) into an indoor fan (21) side (blowoff side of the indoor fan (21)) and a suction grill (12) side (suction side of the indoor fan (21)) in the indoor fan unit (3). Since the indoor fan (21) is provided with the bell mouth (24), air sucked from below the bell mouth (24) by the indoor fan (21) is blown off in a peripheral direction above the bell mouth (24).

Moreover, the air flow partitioning plate of the present embodiment constructed of the bell mouth (24) and the drain pan (23), as shown in FIG. 3, has an opening (24*a*) formed at a position corresponding to one corner of four corners of the main casing (18) shaped like a rectangular solid. This opening (24*a*) constructs an introduction port of an introduction duct (86) that will be described later. In this regard, in a case of the indoor unit (3) not provided with the cleaning unit (100) (only the main unit (10)), the opening (24*a*) is closed by a cover (not shown in the drawing) in such a way as to prevent air blown off from the indoor fan (21) from leaking.

The indoor heat exchanger (22) is formed in rectangular O-shaped when viewed in a plan view and is arranged in the main casing (18) in such a way as to surround the indoor fan (21). In this indoor heat exchanger (22), heat is exchanged between indoor air (blown-off air) sent by the indoor fan (21) and refrigerant circulating in the indoor heat exchanger (22).

The drain pan (23) is arranged on the lower side of the indoor heat exchanger (22). This drain pan (23) is a pan for receiving drain water produced when moisture in the air condenses in the indoor heat exchanger (22). The drain pan (23) is provided with a drain pump (not shown in the drawing) for draining the drain water. Moreover, the drain pan (23) is inclined in such a way as to capture the drain water at a position where the drain pump is arranged.

The electric component box (20) stores various kinds of electric components for controlling the operations of constituent components of the indoor fan (21) and the like in the indoor unit (3). The electric component box (20), as shown in FIG. 3, is arranged below the bell mouth (24) and outside the suction port of the indoor fan (21) so as not to overlap the suction port when viewed in a plan view. In the present embodiment, the electric component box (20) is arranged on the side opposite to the opening (24*a*) formed in the bell mouth (24) across the suction port of the indoor fan (21).

The cleaning unit (100) has a circular air filter (30), a dust removing means (50), a dust carrying device (80), a dust capturing box (90) (dust capturing part), and the like arranged in a chamber casing (101) formed nearly in a rectangular shape when viewed in a plan view. In other words, the cleaning unit (100) is constructed in such a way that dust attached to the air filter (30) positioned on the suction side of the indoor fan (21) is removed by the dust removing means (50) and that the removed dust is carried to the interior of the dust capturing box (90) by the dust carrying device (80) and is stored in the duct capturing box (90), which will be described later in detail.

The chamber casing (101) is formed in the same size of the main casing (18) of the main unit (10) and is arranged on the indoor side of the main casing (18) in the state where the chamber casing (101) and the main casing (18) sandwich a sealing member (102), as shown in FIG. 2. Moreover, the decorative panel (11) is fixed to the indoor side of the chamber casing (101) with a sealing member (103) sandwiched between the decorative panel (11) and the chamber casing (101).

Moreover, the chamber casing (101) has four air passages (101*a*) formed along respective sides. Each of the air passages (101*a*) is provided in such a way as to communicate with a space in the main casing (18) formed outside the indoor heat exchanger (22) in the main unit (10) and is constructed in such a way that air after having exchanged heat with refrigerant in the indoor heat exchanger (22) flows toward the interior of the room. In other words, the air flowing through the air passages (101*a*) of the chamber casing (101) is supplied into an indoor space from a blowoff port (14) formed in the decorative panel (11). In this regard, as shown in FIG. 2, a part forming the inside of the air passage (101*a*) in the chamber casing (101) supports the drain pan (23) of the main unit (10) from below via a sealing member (104).

The decorative panel (11) is formed in a rectangular plate when viewed in a plan view (see FIG. 3). As shown also in FIG. 2, the decorative panel (11) is formed in such a way that the shape, when viewed in a plan view, of the decorative panel (11) is a little larger than the shapes, when viewed in a plan view, of the main casing (18) of the main unit (10) and the chamber casing (101) of the cleaning unit (100). As described above, the decorative panel (11) is fixed to the chamber casing (101) in such a way as to cover the lower side of the chamber casing (101) in the state where the decorative panel (11) and the chamber casing (101) sandwich the sealing member (103). In this way, the decorative panel (11) is exposed to the indoor side in the state shown in FIG. 3.

Moreover, the decorative panel (11) has one suction port (13) and four blowoff ports (14) formed therein, as shown in FIG. 3. The suction port (13) is formed nearly in a rectangular shape in the center of the decorative panel (11) and has a suction grill (12) fitted therein, the suction grill (12) having a slit part (12*a*) to be described later. Each of the blowoff ports (14) is formed in a slender rectangular shape and in such way as to be along each side of the decorative panel (11) in correspondence to the air passage (101*a*) of the cleaning unit (100). Each blowoff port (14) is provided with an air direction control plate (15) (see FIG. 2). This air direction control plate (15) is constructed in such a way that air direction control panel (15) turns to control the direction of air (direction in which air is blown off).

The suction grill (12) is a cover member having the slit part (12*a*) having a plurality of slit-shaped apertures formed in its center and is fitted in the suction port (13) of the decorative panel (11) in such a way as to cover the suction port (13). Moreover, this suction grill (12) has a nozzle insertion part (110) used for inserting a nozzle (150) of a cleaner formed therein, which will be described later. This nozzle insertion part (110) is constructed in such a way as to have the nozzle (150) of the cleaner inserted therein in order to recover dust stored in the dust capturing box (90) of the cleaning unit (100) by the cleaner.

Moreover, the decorative panel (11) is provided with an LED (16) lighted in the case where a specified amount of dust is stored in the dust capturing box (90) of the cleaning unit (100) and in the case where dust attached to the air filter (30) is removed by the dust removing means (50), which will be described later.

<Construction of Cleaning Unit>

Next, the construction of the cleaning unit (100) will be described below in detail on the basis of FIG. 3 to FIG. 15.

As described above, the cleaning unit (100) is a unit having the air filter (30), the dust removing means (50), the dust carrying device (80), the dust capturing box (90), the electric component box (105), and the like arranged in the chamber casing (101) nearly formed in a rectangular shape when viewed in a plan view. The cleaning unit (100) is a unit for cleaning the air filter (30) positioned below the suction port of the indoor fan (21) of the main unit (10).

Moreover, the cleaning unit (100) has a partition plate (25) in such a way as to cover the lower part of the bell mouth (24). This partition plate (25), for example as shown in FIG. 2, partitions a space between the bell mouth (24) and the suction grill (12) into an upper part and a lower part. In other words, the partition plate (25) partitions an upstream space of the indoor heat exchanger (22) into a space near to an indoor heat exchanger (22), which contains the bell mouth (24), and a space near to a suction grill (12).

Figure 5:
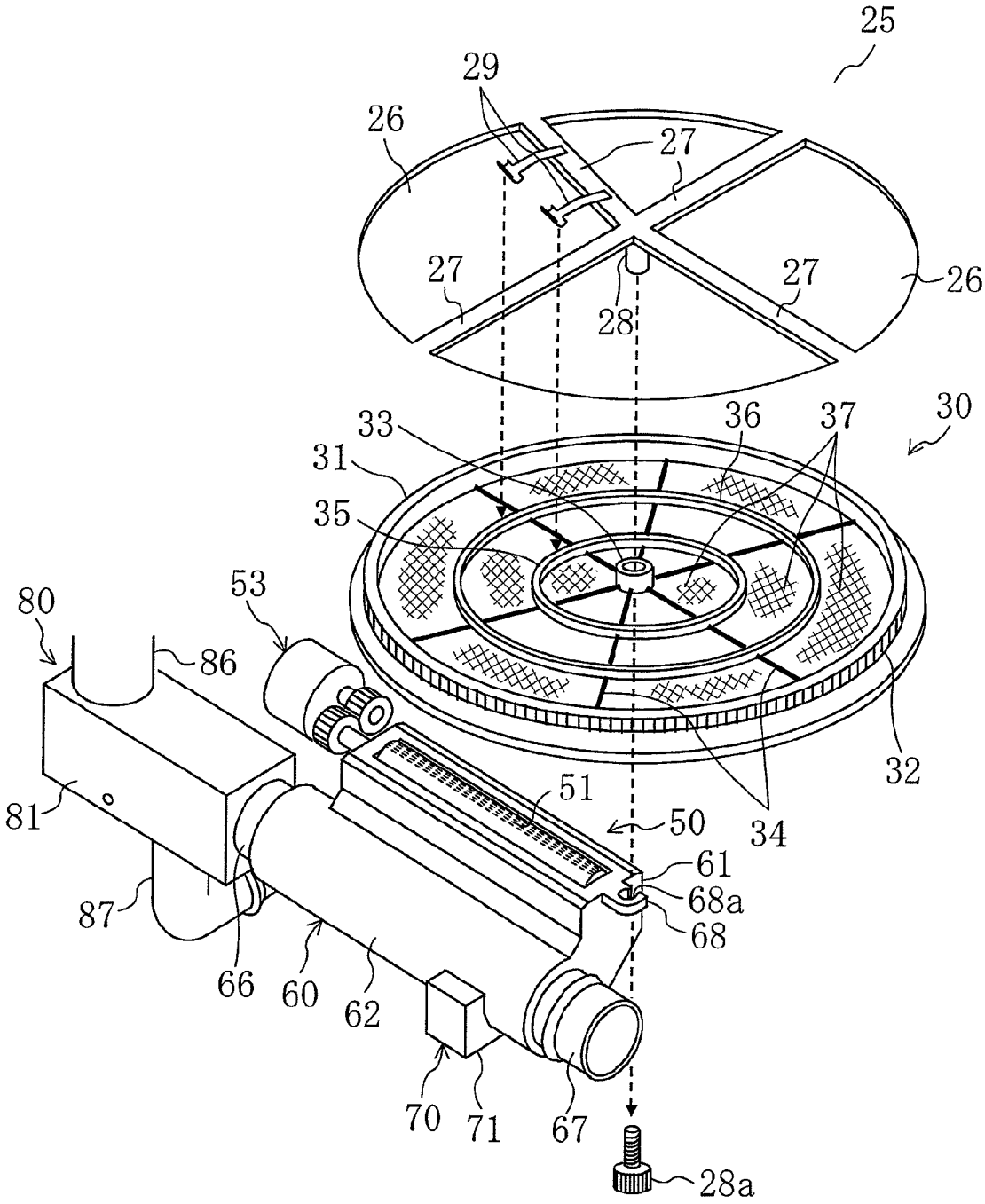
FIG. 5 is a perspective view to show a construction of an air hole of a partition plate, an air filter, and a dust storage container.

The partition plate (25) has an air hole (26), through which air sucked from the suction port (13) flows into the bell mouth (24), formed in the center as shown in FIG. 2 and FIG. 5. This air hole (26) is a circular hole whose interior is partitioned into four fan-shaped parts by four radial beam parts (27) extending in a radial direction. The respective radial beam parts (27) are connected to each other at the center of the air hole (26) and a cylindrical filter rotary shaft (28) (rotary shaft part) is formed in a downward protruding manner at the center thereof. This filter rotary shaft (28) is a rotary shaft for rotating the air filter (30). Moreover, one of the radial beam parts (27) is provided with two filter pressing parts (29) for pressing the air filter (30) from above onto a rotary brush (51) of the dust removing means (50).

In this regard, as will be described later in detail, a service hole (25*a*) is formed at the side of the air hole (26) of the partition plate (25) in such a way as to connect with the air hole (26) and a service cover (106) is arranged in such a way as to close the service hole (25*a*) (see FIG. 24 and FIG. 25).

As described in FIG. 5, the air filter (30) is arranged below the air hole (26) of the partition plate (25) and is formed in a circular plate having a diameter larger than those of the bell mouth (24) and the air hole (26). Specifically, the air filter (30) is provided with a ring-shaped main filter (31) and a mesh member (37). The main filter (31) has a gear part (32) formed on an outer peripheral surface thereof and has a cylindrical shaft passing part (33) formed in the center thereof, the shaft passing part (33) being supported by six radial ribs (34) extending in a radial direction. In other words, the respective radial ribs (34) extend radially from the shaft passing part (33) and join the main filter (31). Moreover, the main filter (31) has a ring-shaped inner peripheral rib (35) and a ring-shaped outer peripheral rib (36) arranged inside, the inner peripheral rib (35) and the outer peripheral rib (36) being arranged coaxially to the main filter (31). The outer peripheral rib (36) is formed to have a diameter larger than the inner peripheral rib (35). Here, as shown in FIG. 6, the shaft passing part (33) has its passing hole (33*a*) formed to have an inner diameter larger than the filter rotary shaft (28) formed in the partition plate (25) and the head part (28*b*) of a setscrew (28*a*) which will be described later.

The mesh member (37) is stretched over the whole inside part of the main filter (31). The air sucked from the suction port (13) passes through the mesh member (37) of the air filter (30) and flows into the bell mouth (24), when dust in the air is captured by the mesh member (37).

Moreover, the filter pressing parts (29) contact onto the top surfaces of the respective ring-shaped peripheral ribs (35), (36), whereby the air filter (30) is urged down. In this way, the air filter (30) is pressed onto the rotary brush (51) of the dust removing means (50) that will be described later. Thus, this construction can improve the efficiency of removing dust by the dust removing means (50).

Figure 6:
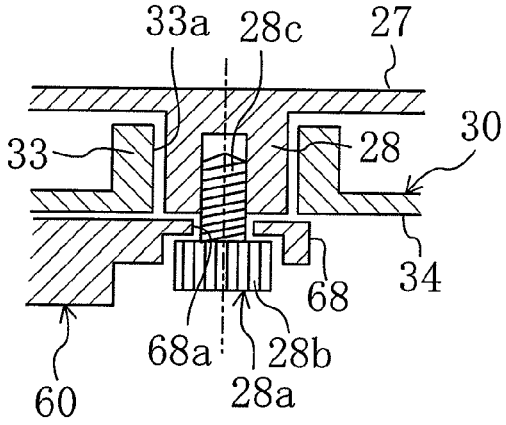
FIG. 6 is a section view to show a structure of mounting the air filter.

As shown in FIG. 5 and FIG. 6, the air filter (30) has its shaft passing part (33) rotatably fitted onto the filter rotary shaft (28) of the partition plate (25). The dust storage container (60) of the dust removing means (50) is arranged below the air filter (30). A filter fixing part (68) of the dust storage container (60), which will be described later, is fixed to the filter rotary shaft (28) of the partition plate (25) by the set-screw (28*a*) in the state where the air filter (30) is fitted onto the filter rotary shaft (28). In this way, the air filter (30) is held in the state where the air filter (30) is sandwiched between the partition plate (25) and the dust storage container (60).

Figure 4:
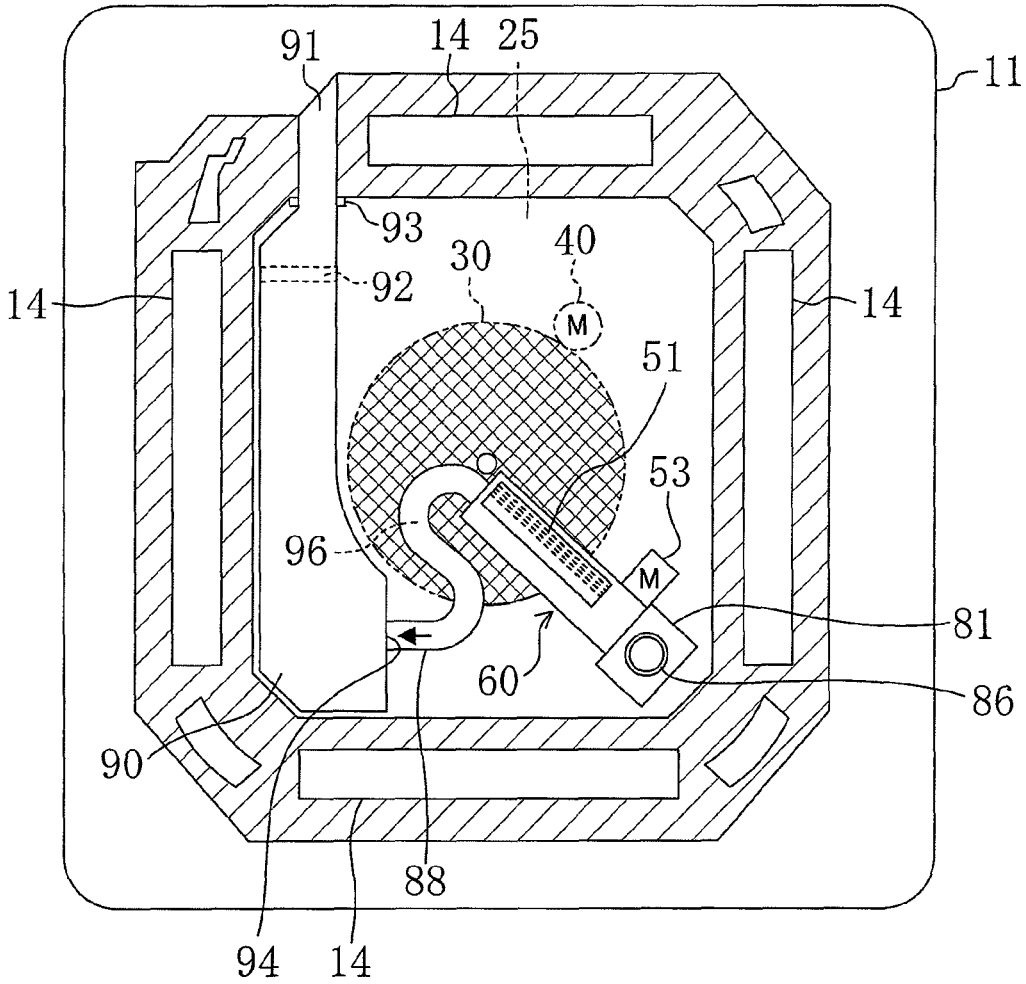
FIG. 4 is a section view taken along a line IV-IV in FIG. 2.
Figure 7:
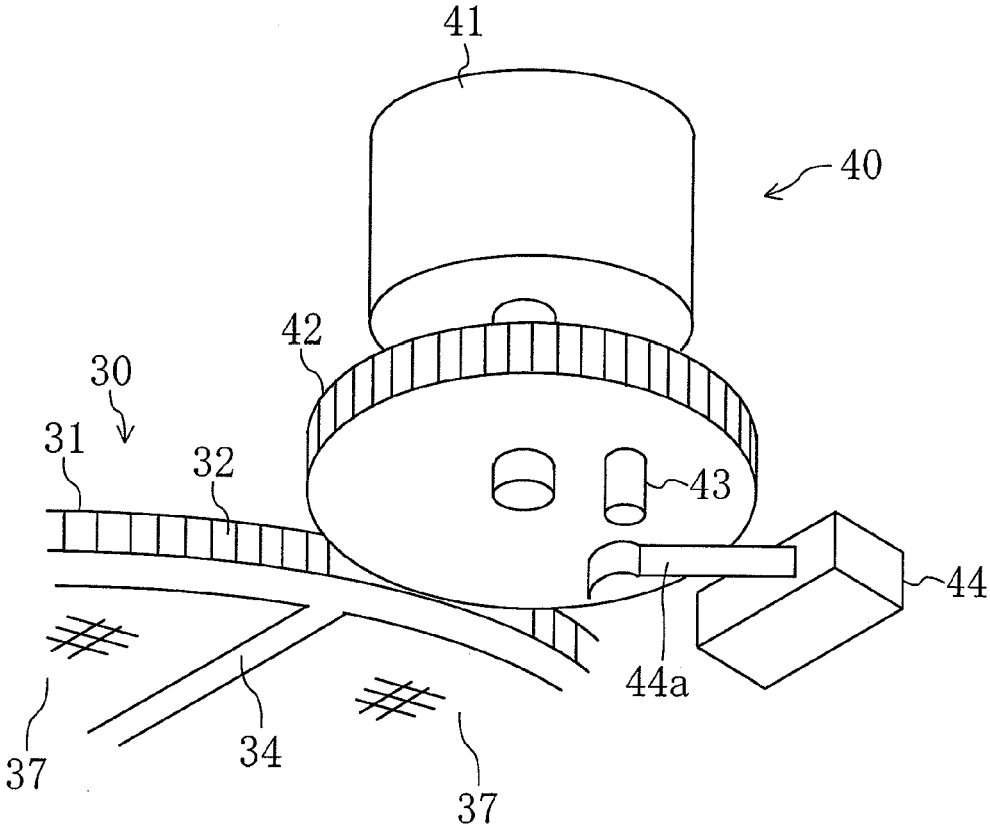
FIG. 7 is a perspective view to show a construction of a filter driving means.

As shown in FIG. 4 and FIG. 7, a filter driving means (40) for rotationally driving the air filter (30) is arranged near the air filter (30). This filter driving means (40), as shown in FIG. 7, is provided with a filter driving motor (41) and a limit switch (44). A driving shaft of the filter driving motor (41) is provided with a driving gear (42), and the driving gear (42) is engaged with the gear part (32) of the air filter (30). The driving gear (42) has a switch activating part (43) of a protruding part provided on one end face thereof (bottom face in an example shown in the drawing). This switch activating part (43) is made to contact a lever (44*a*) of the limit switch (44) by the rotation of the driving gear (42), thereby moving the lever (44*a*). When this lever (44*a*) is moved, the limit switch (44) detects the movement of the lever (44*a*). In other words, the switch activating part (43) and the limit switch (44) are constructed in such a way as to detect the rotation of the driving gear (42). In this way, the timing when the dust removing means (50) is operated can be detected according to the number of rotations of the driving gear (42) and an abnormality when the driving gear (42) is not rotated can be detected.

Next, the dust removing means (50), a storage amount detecting means (70), the dust carrying device (80), and the dust capturing box (90), all of which are provided in the cleaning unit, will be described with reference to FIG. 8 to FIG. 15.

Figure 10:
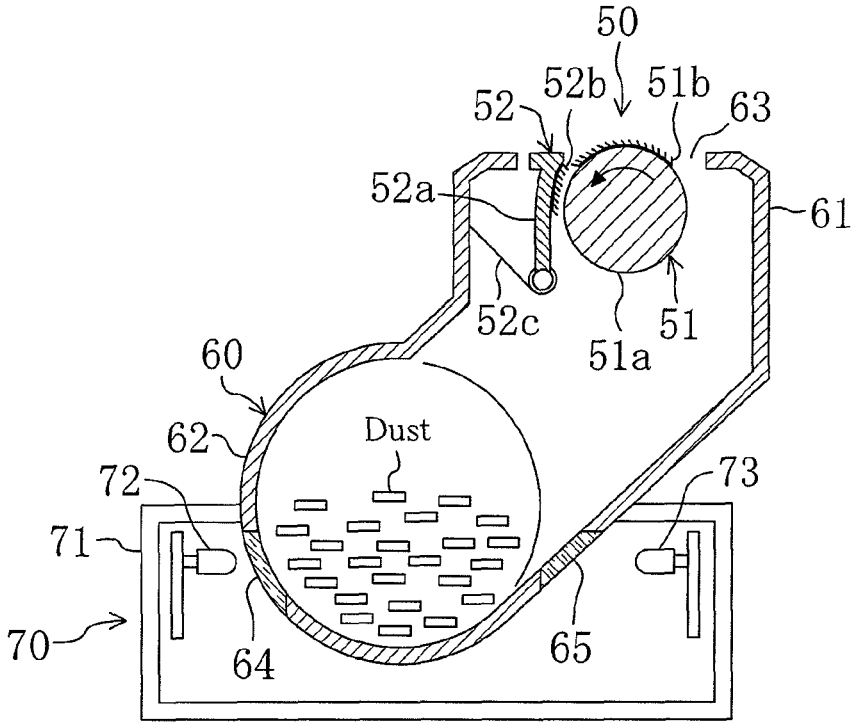
FIG. 10 is a section view taken along a line X-X in FIG. 8.
Figure 11:
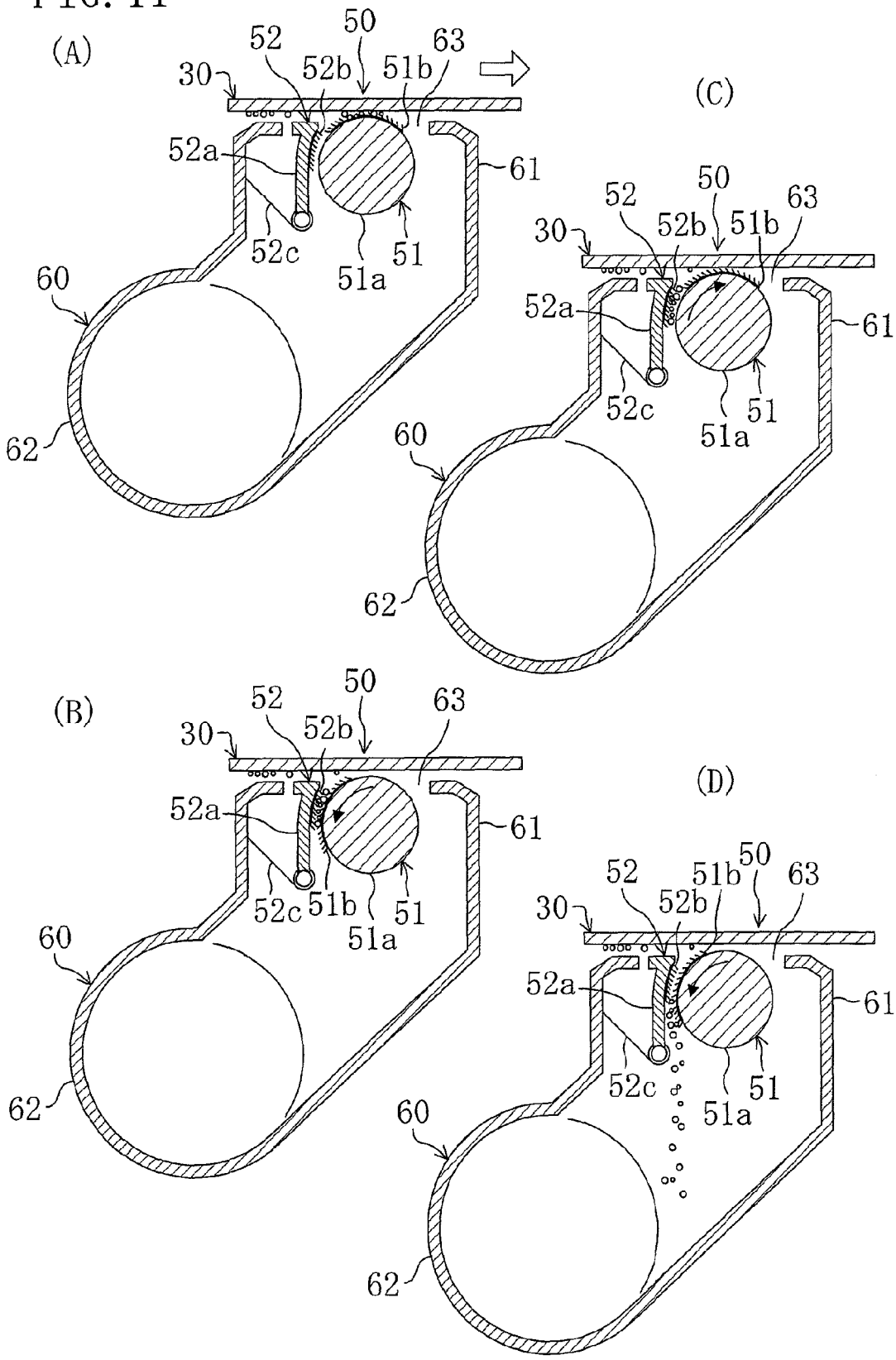
FIGS. 11A to 11D are section views taken along a line XI-XI in FIG. 8 and show an action of a rotary brush at the time of a dust removing operation and at the time of a brush cleaning operation.

The dust removing means (50) is a means for removing dust captured by the air filter (30). This dust removing means (50), as shown in FIG. 10 and FIG. 11, is provided with the rotary brush (51) and a cleaning brush (52) (dust removing part) which are brush parts, a brush driving means (53), and the dust storage container (60) for storing the removed dust. As shown in FIG. 10, the rotary brush (51) and the cleaning brush (52) are arranged in an opening (63) for a brush of the dust storage container (60).

The rotary brush (51) is provided with a slender cylindrical shaft (51*a*) and a brush (51*b*) fixed to an outer peripheral surface of the shaft (51*a*). This brush (51*b*) is constructed of a plurality of implanted piles. The brush (51*b*) is fixed to a part in the peripheral direction of the outer surface of the shaft (51*a*) along the axial direction of the shaft (51*a*).

The cleaning brush (52) is arranged on one side of the rotary brush (51) in such a way as to be put into contact with the rotary brush (51). The cleaning brush (52) is provided with a main part (52*a*), a brush (52*b*), and a spring part (52*c*). This main part (52*a*) is a plate-shaped part and is formed in such a way as to correspond to the shaft (51*a*) of the rotary shaft (51) and to be as long as the shaft (51*a*). The main part (52*a*) is arranged at a specified spacing from and opposite to the outer peripheral surface of the rotary brush (51). Moreover, the upper part of the main part (52*a*) is formed in a circular shape in such a way as to follow the outer peripheral surface of the shaft (51*a*) of the rotary shaft (51). The circular upper part of the main shaft (52*a*) is provided with the brush (52*b*) along the longitudinal direction of the main part (52*a*). The spring part (52*c*) is constructed of a plate spring and has its one end connected to the bottom of the main part (52*a*) and has the other end connected to the inner wall of the dust storage container (60). In other words, the main part (52*a*) has its bottom part supported by the spring part (52*c*).

The rotary brush (51) and the cleaning brush (52) are each formed in such a way as to be equal to or longer than the radius of the circular air filter (30), and are arranged in such a way as to extend in the radial direction from the circular center of the air filter (30). In other words, as shown in FIG. 4, the dust removing means (50) is arranged in such a way as to extend in the radial direction of the air filter (30).

The rotary brush (51) is constructed in such a way that the brush (51*b*) is put into contact with the mesh member (37) of the rotating air filter (30) to remove dust from the mesh member (37). Moreover, the rotary brush (51), as shown in FIG. 10 and FIG. 11, is reversibly rotationally driven by the brush driving means (53).

Figure 8:
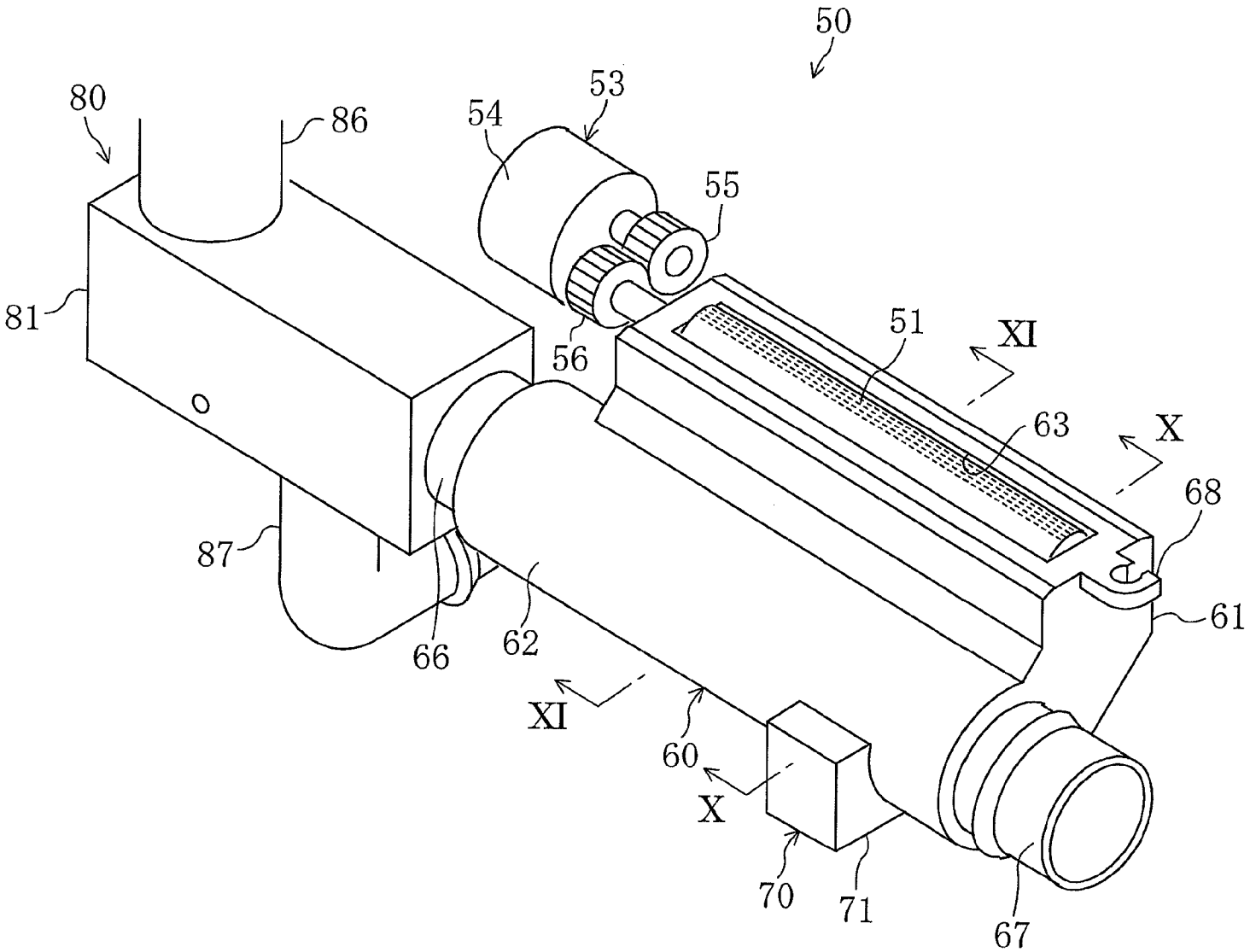
FIG. 8 is a perspective view, when viewed from above, of a dust removing means and the dust storage container.
Figure 9:
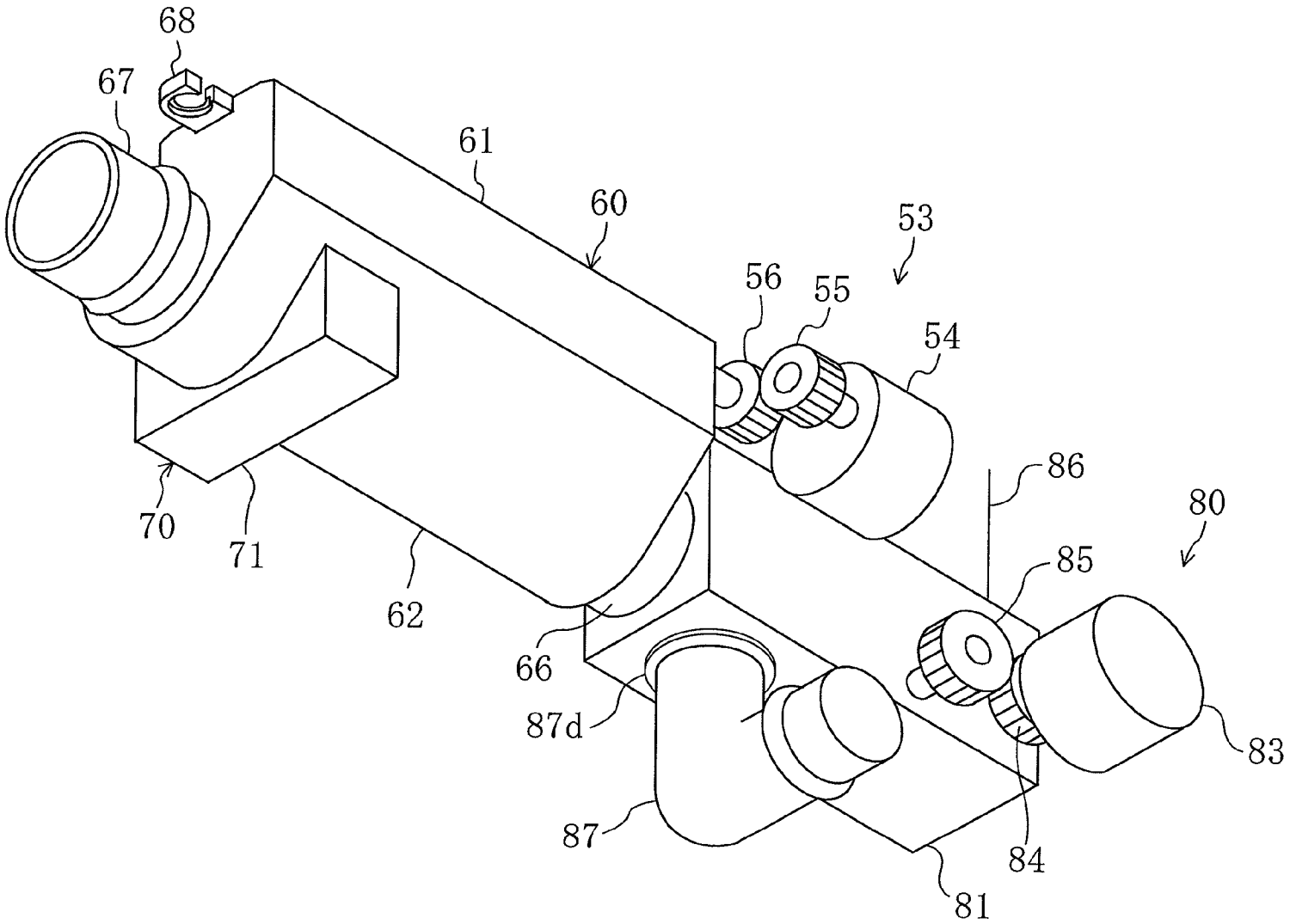
FIG. 9 is a perspective view, when viewed from below, of the dust storage container.

The brush driving means (53), as shown in FIG. 8 and FIG. 9, is provided with the brush driving motor (54) and a driving gear (55) and a driven gear (56) which are engaged with each other. The driving gear (55) is fixed to a driving shaft of the brush driving motor (54), and the driven gear (56) is fixed to an end part of the shaft (51*a*) of the rotary brush (51).

With this construction, the rotation of the brush driving motor (54) is transmitted to the rotary brush (51) via the driving gear (55) and the driven gear (56), whereby the rotary brush (51) is rotationally driven.

With the construction, when the rotary brush (51) is rotated by the brush driving means (53), the brush (52*b*) of the cleaning brush (52) is put into contact with the brush (51*b*) of the rotary brush (51), whereby dust is removed from the brush (51*b*) of the rotary brush (51) by the cleaning brush (52). In other words, the cleaning brush (52) is a brush for removing dust from the rotary brush (51) to clean the rotary brush (51), and the brush driving means (53) is a means for rotating the rotary brush (51) in such a way as to smear the dust captured by the brush (51*b*) of the rotary brush (51) on the cleaning brush (52).

Moreover, the respective brushes (51*b*), (52*b*) of the rotary brush (51) and the cleaning brush (52) are constructed of the so-called pile fabric. This pile fabric is a pile-woven textile in which piles (pile fibers) are woven into a ground fabric and has comparatively short piles. Moreover, this pile fabric is a slant-pile fabric in which the piles are slanted in a specified direction.

Specifically, the piles of the brush (51*b*) of the rotary brush (51) are slanted to the left from the shaft (51*a*) in FIG. 10. In other words, the piles of the brush (51*b*) are slanted in such a way as to be opposite to the rotational direction of the air filter (30). In this way, when the air filter (30) is rotated in such a way as to be opposite to the piles of the brush (51*b*), the dust captured by the mesh member (37) is effectively scraped away.

Moreover, the piles of the brush (52*b*) of the cleaning brush (52) are slanted obliquely downward from the main part (52*a*) in FIG. 10. In other words, the piles of the brush (52*b*) are slanted in such a way as to be opposite to the rotational direction of the rotary brush (51) when the rotary brush (51) is rotated clockwise in FIG. 10. In this way, the rotary brush (51) is rotated in such a way as to be opposite to the piles of the brush (52*b*) of the cleaning brush (52), so that the dust attached to the brush (51*b*) of the rotary brush (51) can be removed by the brush (52*b*) of the cleaning brush (52).

In this regard, the dust removing operations of the rotary brush (51) and the cleaning brush (52) will be described later in detail.

The dust storage container (60) is a container for capturing the dust removed from the rotary brush (51) by the cleaning brush (52) and for temporarily storing the dust. The dust storage container (60) is a pillar-shaped container in which an upper part is bulged to the right side with respect to a lower part when viewed in a side view (when viewed from the right side in FIG. 8) and which is bent slightly in inverted C-shaped. In the dust storage container (60), its upper part is a removing part (61) in which the rotary brush (51) for removing the dust of the air filter (30) and the like are arranged and its lower part is a storing part (62) in which the dust removed from the air filter (30) by the rotary brush (51) is stored.

Specifically, the removing part (61) has the opening (63) for the brush formed in its top surface in such a way as to extend in its longitudinal direction. As described above, the rotary brush (51) and the cleaning brush (52) of the dust removing means (50) are arranged in the opening (63) for the brush. Moreover, the removing part (61) has the filter fixing part (68) fixed to one side surface of the removing part (61). Here, the construction of the filter fixing part (68) and the connection structure of the filter fixing part (68) and the air filter (30) will be described later.

The storing part (62) has its lower end side (bottom side) bulged in a circular arc shape when viewed in a section view. The dust removed from the rotary brush (51) by the cleaning brush (52) is dropped and stored in a circular arc part of the storing part (62). Moreover, the storing part (62) is formed in a cylindrical shape and is opened at both ends (66), (67) in its longitudinal direction. The storing part (62) has a dumper box (81) of the dust carrying device (80), which will be described later, connected to a first end part (66) thereof and has a carrying duct (88) of the dust carrying device (80), which will be described later, connected to a second end part (67) thereof.

Moreover, as shown in FIG. 10, the dust storage container (60) is provided with a storage amount detecting means (70) for detecting the amount of dust stored in the storing part (62). This storage amount detecting means (70) is provided with a light emitting diode LED (72) and a phototransistor (73) both of which are stored in a sensor box (71). The sensor box (71) is arranged near to the second end part (67) of the storing part (62) of the dust storage container (60) in such a way as to extend in a transverse direction of the storing part (62) and to cover a bottom part thereof (see FIG. 5, FIG. 8, and FIG. 9). The light emitting diode LED (72) and the phototransistor (73) are arranged opposite to each other in the sensor box (71) in such a way as to sandwich the storing part (62) in a transverse direction thereof. On the other hand, the storing part (62) has a first transparent window (64) and a second transparent window (65) formed in a wall thereof in such a way that the first transparent window (64) and the second transparent window (65) correspond to the light emitting diode LED (72) and the phototransistor (73), respectively.

With the construction, in the storage amount detecting means (70), light produced by the light emitting diode LED (72) passes through the first transparent window (64) and the second transparent window (65) in order and then luminous intensity is detected by the phototransistor (73). The amount of dust (the degree of charge) in the storing part (62) can be detected according to the luminous intensity detected by the phototransistor (73). That is to say, when the amount of storage of the dust is small, the transmissivity of light from the first transparent window (64) to the second transparent window (65) in the storing part (62) becomes high and hence the luminous intensity detected by the phototransistor (73) becomes high. On the contrary, when the amount of storage of the dust is large, the transmissivity of light from the first transparent window (64) to the second transparent window (65) in the storing part (62) becomes low and hence the luminous intensity detected by the phototransistor (73) becomes low. Thus, according to the storage amount detecting means (70), it is possible to judge that, for example, when the luminous intensity becomes a specified value or less, the amount of storage of dust in the storing part (62) is large. In this way, when it is detected by the storage amount detecting means (70) that the amount of storage of dust in the storing part (62) is large even after the dust carrying operation of carrying dust in the storing part (62) is performed by the dust carrying device (80) which will be described later, it is possible to judge that the dust capturing box (90) to which the dust is carried is full.

Moreover, as described above, the storage amount detecting means (70) is arranged near to the second end part (67) of the storing part (62) connecting to the carrying duct (88), so that when the dust is carried in the carrying duct (88) and is captured in the dust capturing box (90), even if the second end part (67) is clogged with the dust, it is possible to detect the state of clogging. In other words, in the construction of the present embodiment, a portion near the second end part (67) of the storing part (62), which is a portion connecting to the carrying duct (88), tends to be most clogged with the dust. By arranging the storage amount detecting means (70) at the part, it is possible to further reliably detect the part to be clogged with the dust.

The dust capturing box (90) is a box to which the dust in the dust storage container (60) is carried by the dust carrying device (80), which will be described later, and in which the dust is stored. The dust capturing box (90), for example as shown in FIG. 3 and FIG. 4, is formed nearly in the shape of a slightly slender rectangular solid and is arranged below the partition plate (25) similarly to the dust storage container (60). The dust capturing box (90) is arranged at the side of the air filter (30) and along one end side of the partition plate (25) in such a way as not to overlap the air filter (30) when viewed in a plan view. In the present embodiment, the dust capturing box (90) is arranged at a position opposite to the dumper box (81) across the air filter (30) and below the electric component box (20) of the main unit (10) and the service cover (106) (see FIG. 23 to FIG. 25). Moreover, in order to reliably prevent the dust capturing box (90) from interfering with the air filter (30), the dust capturing box (90) has a side plate on a side near to the air filter (30) formed in a circular arc shape in correspondence to the outer periphery of the air filter (30).

Moreover, the dust capturing box (90) has an inflow port (94) formed in a side face of one end (one side end) thereof and has the other end side of the carrying duct (88) connected to the inflow port (94). On the other hand, the other end (other side end) of the dust capturing box (90) passes through the chamber casing (101) of the cleaning unit (100) and has an air outlet (91) open to the outside of the casing (101) formed in an end face thereof. In other words, the dust capturing box (90) has the air outlet (91) formed in an end opposite to a side to which the carrying duct (88) is connected, so that air flows easily in a longitudinal direction in the dust capturing box (90). In this regard, in the dust capturing box (90), a part on the side of the air outlet (91) is made smaller in cross-section area than the other part. Here, in FIG. 4, a reference character (93) designates a sealing member for sealing a part passing through the chamber casing (101) of the dust capturing box (90) from inside the casing.

Moreover, the dust capturing box (90) has a filter (92) arranged near the air outlet (91). With this filter (92), when the dust is carried from the dust storage container (60) into the dust capturing box (90), air is discharged from the air outlet (91) whereas the carried dust is captured by the filter (92) and is prevented from flowing out from the air outlet (91). Moreover, when the dust is discharged from the dust capturing box (90) by the suction of a cleaner, indoor air flows into the dust capturing box (90) through the air outlet (91), but the dust in the air flowing into the dust capturing box (90) is captured by the filter (92).

As described above, a pressure balance in the dust capturing box (90) is suitably adjusted by the air charged or discharged through the air outlet (91), so that the operation of carrying or discharging the dust into or from the dust capturing box (90) can be suitably performed.

The electric component box (105) is a box for storing electronic components and the like for driving and controlling a filter driving means (40) in the cleaning unit (100), the dust removing means (50), and the dust carrying device (80). The electric components stored in the electric component box (105) are electrically connected to the electric components in the electric component box (20) of the main unit (10) by signal wires or the like in such a way as to send or receive signals.

Moreover, the electric component box (105), as shown in FIG. 3, is arranged below the partition plate (25) of the cleaning unit (100), on a side adjacent to a side on which the dust capturing box (90) is arranged, and at a position opposite to the dumper box (81) connected to the dust storage container (60) across the air filter (30). In this way, as will be described later in detail, when the service cover (106) and the air filter (30) fixed to the partition plate (25) of the cleaning unit (100) are removed at the time of maintenance, it is possible to reliably prevent the electric component box (105) from interfering with the dust storage container (60) even if the dust storage container (60) is turned.

<Turning Structure>

Next, a turning structure of the dust removing means (50) will be described below in detail on the basis of FIG. 12 and FIG. 13.

As described above, the dust storage container (60) of the dust removing means (50) is connected to the dumper box (81) at the first end part (66). The dumper box (81) has the introduction duct (86) connected to the top surface thereof and the introduction duct (86) communicates with a first chamber (81*a*) in the dumper box (81). This introduction duct (86), as shown in FIG. 12, extends vertically upward in such a way as to pass through the partition plate (25) arranged between the cleaning unit (100) and the main unit (10) and has the other end side connected to an extending part of the drain pan (23) of the main unit (10).

Moreover, the introduction duct (86) is provided with an upstream duct (86*a*) and a downstream duct (86*b*) both of which have a circular cross section and these two ducts (86*a*), (86*b*) are joined to each other in a vertical direction by setscrews (86*c*).

The upstream duct (86*a*) is formed in such a way that a cross-section area (channel area) thereof is larger than a cross-section area (channel area) of the downstream duct (86*b*). The bottom end (lower side in FIG. 12) of this downstream duct (86*b*) is connected to the top surface of the dumper box (81), whereas the top end (upper side in FIG. 12) of the upstream duct (86*a*) is made to contact a horizontally extending part of the drain pan (23) via a sealing member (86*e*). The extending part of the drain pan (23) has an introduction port (86*d*) of a through hole formed therein, so that the upstream duct (86*a*) communicates with a space on a side near to the indoor fan (21) through this introduction port (86*d*).

Moreover, the upstream duct (86*a*) has a stepped part (86*f*) formed therein in such a way as that its lower part is smaller in diameter than its upper part. The downstream duct (86*b*) has a flange part (86*g*) formed at an upper part thereof, the flange part (86*g*) expanding to the outside. The stepped part (86*f*) of the upstream duct (86*a*) and the flange part (86*g*) of the downstream duct (86*b*) are joined to each other with setscrews (86*c*) in a state where they overlap each other in a vertical direction.

Figure 12:
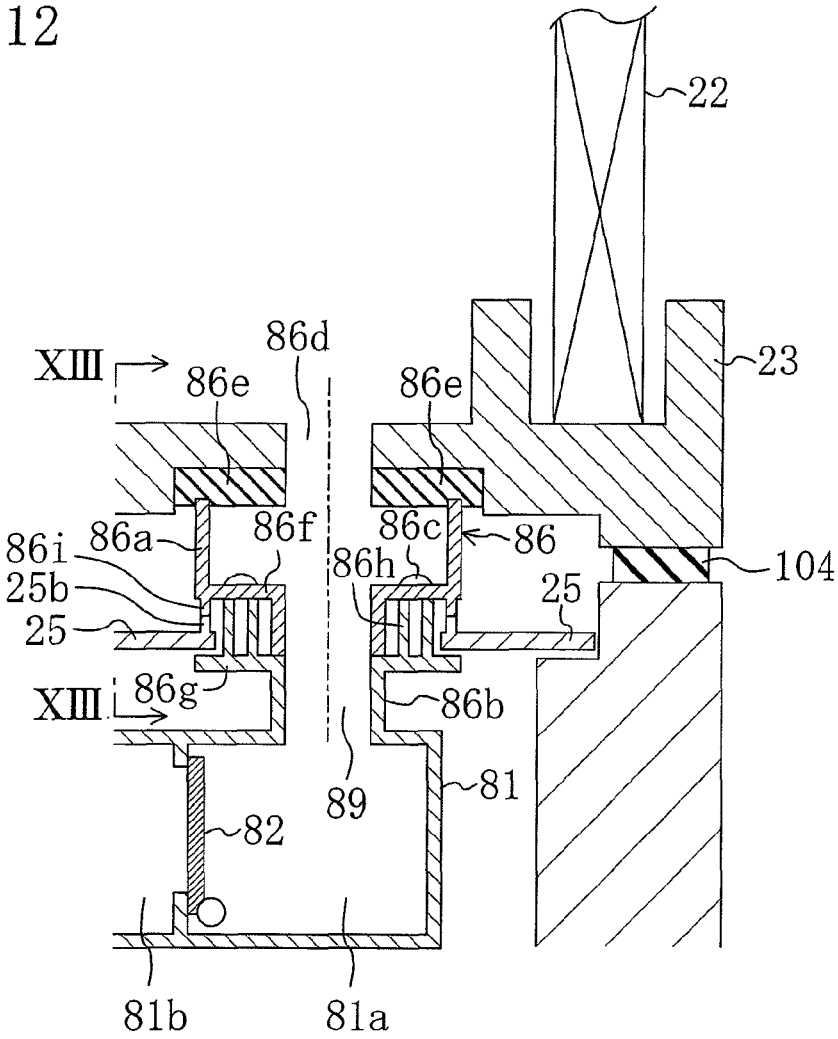
FIG. 12 is an enlarged section view of an introduction duct.

Here, a screw setting part (86*h*) in which the setscrews (86*c*) are screwed, as shown in FIG. 12, is formed on the top surface of the flange part (86*g*) of the downstream duct (86*b*), so that a clearance is formed in an outer peripheral part between the stepped part (86*f*) of the upstream duct (86*a*) and the flange part (86*g*) of the downstream duct (86*b*). The upstream duct (86*a*) and the downstream duct (86*b*) are joined to each other in such a way that a peripheral edge part of the opening of the partition plate (25) is located in this clearance. This construction can connect the top end of the introduction duct (86) to the bell mouth (24) with the peripheral edge part of the opening of the partition plate (25) sandwiched in such a way as to prevent the introduction duct (86) from dropping.

Further, as described above, the construction of sandwiching the peripheral edge part of the opening of the partition plate (25) between the stepped part (86*f*) of the upstream duct (86*a*) and the flange part (86*g*) of the downstream duct (86*b*) can make a part in which the upstream duct (86*a*) is joined to the downstream duct (86*b*) turn with respect to the partition plate (25). In addition, the present embodiment is constructed in such a way that also a part in which the upstream duct (86*a*) contacts the sealing member (86*e*) can be turned, so that the introduction duct (86), the dumper box (81) and the dust removing means (50) can be integrally turned around an axis (introduction port) of the introduction duct (86). Thus, the dust removing means (50) can be switched between a dust removing position in which the dust is removed from the air filter (30) (see FIG. 23) and a maintenance position in which at least a part of the dust removing means (50) does not overlap the air filter (30) when viewed in a plan view (see FIG. 24).

A protruding part (86*i*) protruding downward is formed on the outer peripheral side of the stepped part (86*f*) of the upstream duct (86*a*). Moreover, a protruding part (25*b*) protruding upward is formed on the top surface of the partition plate (25) and at a position corresponding to the protruding part (86*i*) of the introduction duct (86) when the dust removing means (50) is at the dust removing position. These protruding parts (86*i*), (25*b*) are formed in a protruding shape in such a way as to extend in a direction in which the introduction duct (86) is turned and are formed in lengths in which they do not contact to each other when the dust removing means (50) is at the maintenance position. Thus, the protruding parts (86*i*), (25*b*) contact to each other in the vertical direction when the dust removing means (50) is at the dust removing position (see FIG. 13A). On the other hand, the protruding parts (86*i*), (25*b*) do not contact to each other when the dust removing means (50) is at the maintenance position (see FIG. 13B). In this way, when the dust removing means (50) is at the dust removing position, the introduction duct (86) and the dust removing means (50) are raised by a protruding height of the protruding part (25*b*) with respect to the partition plate (25), whereby the dust removing means (50) is pressed onto the bottom surface of the air filter (30). On the other hand, while the dust removing means (50) is turned to the maintenance position, the introduction duct (86) and the dust removing means (50) are located at a lower position than when the dust removing means (50) is at the dust removing position, whereby the dust removing means (50) is separated below from the air filter (30). Therefore, by turning the introduction duct (86), it is possible to change the height position of the dust removing means (50) with respect to the air filter (30).

With this construction, in the case where the maintenance position of the dust removing means (50) is a position in which at least a part of the dust removing means (50) overlaps the air filter (30) when viewed in a plan view, the dust removing means (50) is located at the maintenance position, which can prevent the air filter (30) from interfering with the dust removing means (50) when the air filter (30) is mounted or dismounted. Therefore, it is possible to improve the maintenance workability of the air filter (30).

Figure 13:
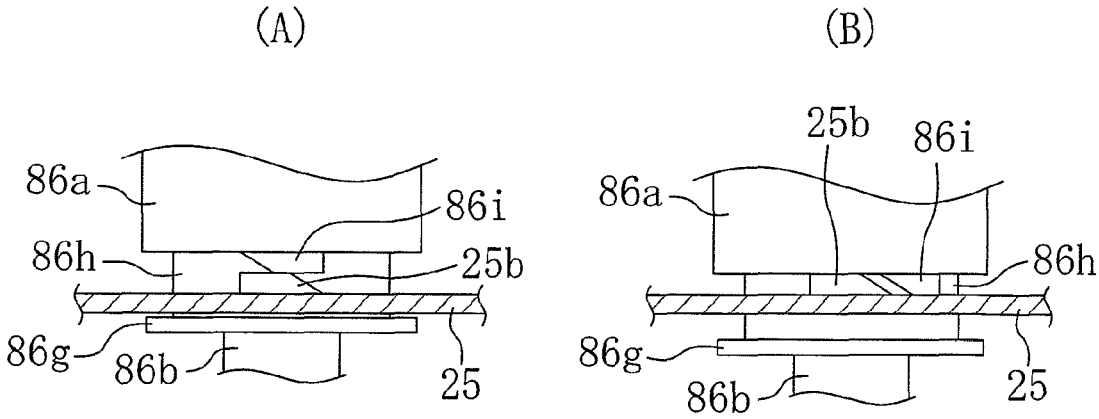
FIGS. 13A and 13B are section views taken along a line XIII-XIII in FIG. 12.

In this regard, the respective protruding parts (86*i*), (25*b*), as shown in FIG. 13, are formed in such a way that their end parts on a side opposite to each other when the dust removing means (50) is located at the maintenance position are gradually made smaller in a protruding height toward their tips in a direction in which the protruding parts (86*i*), (25*b*) extend, so that when the introduction duct (86) is turned to switch the dust removing means (50) to the dust removing position or the maintenance position, the protruding parts (86*i*), (25*b*) are smoothly made to contact to each other or separated from each other. Thus, this construction can smoothly move the introduction duct (86) and the dust removing means (50) in the vertical direction.

<Air Filter Mounting Structure>

When the cleaning unit (100) is provided with a mechanism for turning the dust removing means (50) and the like, as described above, an air filter mounting structure capable of easily dismounting the air filter (30) at the time of maintenance can be realized Specifically, as shown in FIG. 5, FIG. 6, FIG. 8, and FIG. 9, a filter mounting part (68) for mounting the air filter (30) is formed at one side surface of a removing part (61) of the dust storage container (60). This filter mounting part (68) is a part formed in a protruding manner nearly in the shape of a letter U when viewed in a plan view in such a way as to be open in a direction in which the removing part (61) protruding laterally from the storing part (62) protrudes. In other words, the filter mounting part (68) has a slit part (68*a*) formed therein, the slit part (68*a*) being open in the direction in which the removing part (61) protrudes. The slit part (68*a*), as shown in FIG. 6, is formed in such a way that a maximum width size is larger than the diameter of a screw part (28*c*) of the setscrew (28*a*) screwed in the filter rotary shaft (28) of the partition plate (25) and is smaller than the diameter of the filter rotary shaft (28).

With this construction, as shown in FIG. 6, when the setscrew (28*a*) is screwed into the filter rotary shaft (28) in the state where the air filter (30) is sandwiched between the filter mounting part (68) and the radial beam part (27) of the partition plate (25), the air filter (30) can be fixed to the filter mounting part (68) and the partition plate (25). On the other hand, when the air filter (30) is dismounted, the setscrew (28*a*) is loosened and the dust storage container (60) including the filter mounting part (68) having the slit part (68*a*) formed therein is turned opposite to a direction in which the removing part (61) protrudes (opposite to a direction in which the filter mounting part (68) is open), whereby only the filter mounting part (68) that is a part for pressing the air filter (30) from below can be moved in the horizontal direction from below the shaft passing part (33) of the air filter (30) in the state where the tip part of the setscrew (28*a*) is screwed in the filter rotary shaft (28). Here, the shaft passing part (33) of the air filter (30) has its inner diameter formed in a larger size than the filter rotary shaft (28) of the partition plate (25) and the head part (28*b*) of the setscrew (28*a*), so that the air filter (30) can be dismounted from below.

The air filter mounting structure described above makes it possible to easily dismount the air filter (30) without removing the setscrew (28*a*) at the time of maintenance.

<Dust Carrying Device>

As shown in, for example, FIG. 4, FIG. 5, FIG. 8, FIG. 12, and FIG. 14, the dust carrying device (80) is provided with the dumper box (81), the carrying duct (88), the introduction duct (86), and a duct for suction (suction duct) (87), which have been described above.

Figure 14:
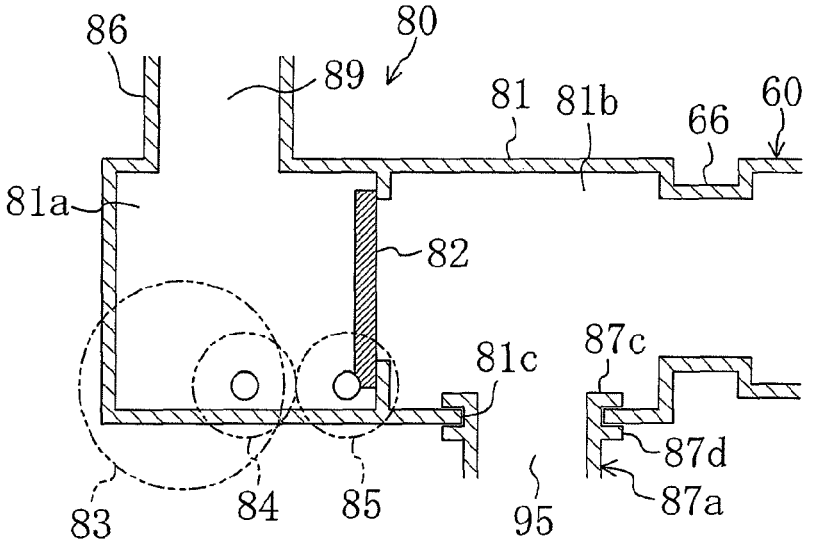
FIGS. 14A to 14C are section views to show an action of a dumper of a dust carrying device.
Figure 14:
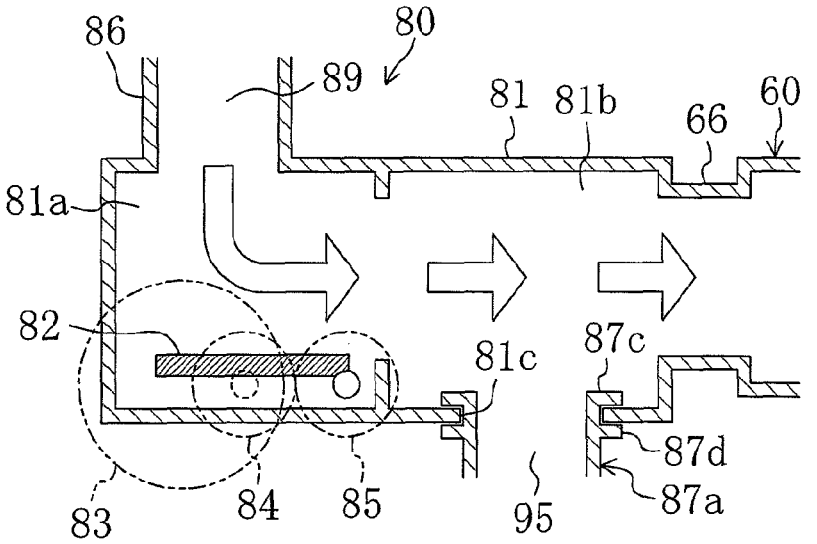
Figure 14:
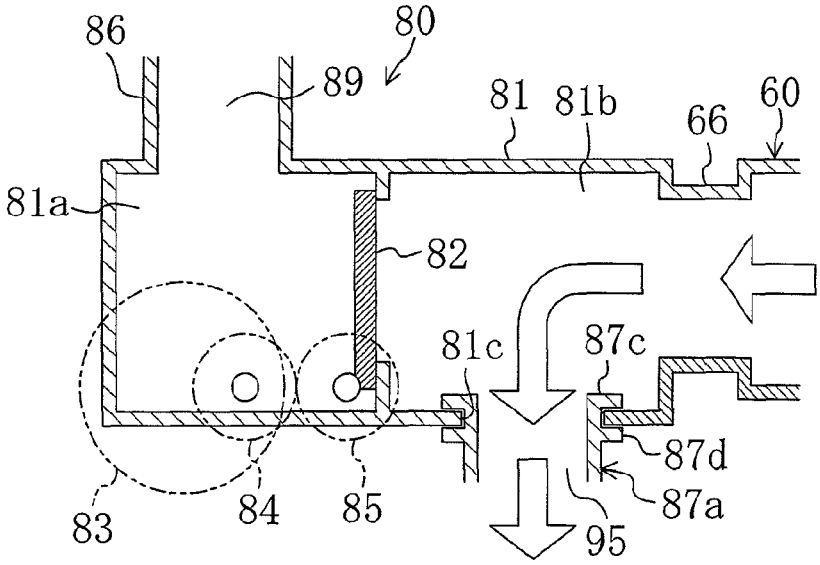

The dumper box (81) is formed in the shape of a rectangular solid and has its longitudinal one end side connected to the first end part (66) of the storing part (62). Thus, a storage container of the present invention is constructed of this dumper box (81) and the dust storage container (60), and a connection passage part to which the respective ducts (86), (87), (88) are connected is constructed of the dumper box (81), as will be described later As shown in FIG. 12 and FIG. 14, a dumper (channel switching device) (82) as an opening/closing member is arranged in the dumper box (81). When this dumper (82) is closed, an inner space of the dumper box (81) is partitioned in its longitudinal direction. In other words, the inner space of the dumper box (81) is partitioned by the dumper (82) into a first chamber (81*a*) on the other end side and a second chamber (81*b*) on a side, which is one end side, near to the dust storage container (60). The second chamber (81*b*) partitioned on the one end side of the dumper box (81), as described above, has the first end part (66) of the storing part (62), whereby the second chamber (81*b*) communicates with the storing part (62).

As shown in FIG. 9 and FIG. 14, the dust carrying device (80) is provided with: a dumper driving motor (83) for opening and closing the dumper (82); a driving gear (84); and a driven gear (85). This driving gear (84) is connected to a driving shaft of the dumper driving motor (83) and the driven gear (85) is connected to a turning shaft of the dumper (82). The driving gear (84) and the driven gear (85) are arranged in such a way as to engage with each other. With this construction, the rotation of the dumper driving motor (83) is transmitted to the turning shaft of the dumper (82) via the respective gears (84), (85). In this way, a dumper opening/closing operation of turning the dumper (82) around the turning shaft is performed by the rotation of the dumper driving motor (83).

The introduction duct (86) has its one end side connected to the top surface of the dumper box (81) and communicates with the first chamber (81*a*) in the dust box (81). On the other hand, the other end side of the introduction duct (86), as shown in FIG. 12, extends vertically upward from the dumper box (81) and passes through the partition plate (25) placed between the cleaning unit (100) and the main unit (10) and is connected to an extending part of the drain pan (23) of the main unit (10). This extending part of the drain pan (23) has an introduction port (86*d*) of a through hole formed therein. The introduction duct (86) communicates with a space on a side near to the indoor fan (21) through this introduction port (86*d*). In other words, this introduction duct (86) is constructed in such a way as to introduce air blown off from the indoor fan (21) into the dumper box (81). Thus, a blown-off air passage (89) is formed in the introduction duct (86), and the interior of the introduction duct (86) and the dust box (81)

becomes an air passage of the blown-off air. Here, the construction of the introduction duct (86) will be described in detail in the description of a turning structure to be described later.

Figure 15:
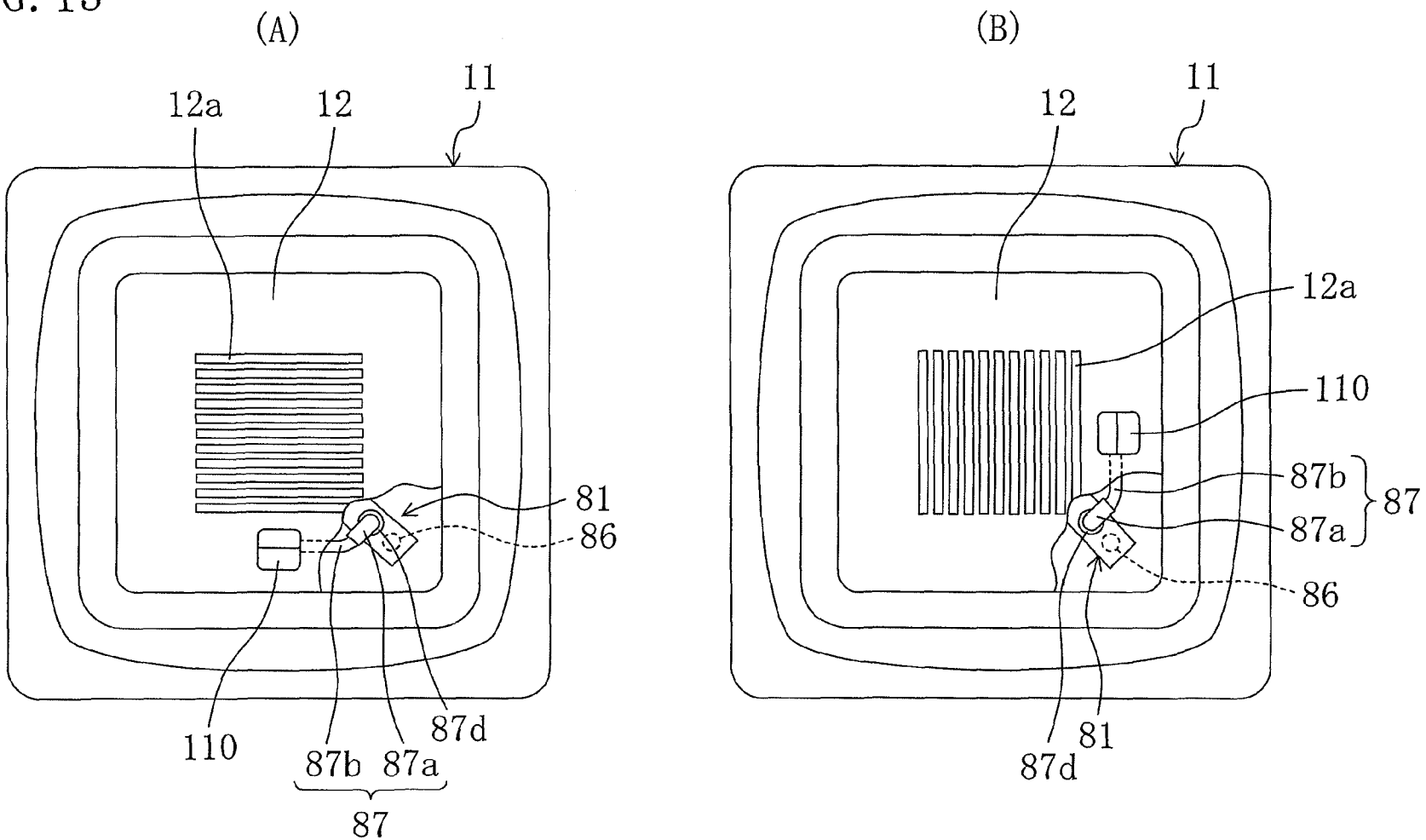
FIGS. 15A and 15B are partial section views, when viewed from inside a room, of a decorative panel with parts partially broken away.

The suction duct (87), as shown for example in FIG. 14 and FIG. 15, has one end of an inflow side connected to a bottom surface on one end side of the dumper box (81) (between the introduction duct (86) and the duct storage container (60)) and communicates with the second chamber (81*b*) in the dumper box (81). On the other hand, the other end of an outflow side of the suction duct (87) is connected to the nozzle insertion part (110) formed in the decorative panel (11). This nozzle insertion part (110) has an opening into which a nozzle (150) of a cleaner is inserted to suck air and dust. In this way, a suction passage (95) is formed in the suction duct (87), and the dust and the air sucked by the nozzle (150) of the cleaner flows in the suction passage (95).

Specifically, the suction duct (87), as shown in FIG. 15, is constructed of: a connection pipe (connection portion) (87*a*) turnably provided on the bottom surface of the dumper box (81); and a flexible duct (87*b*) for connecting the connection pipe (87*a*) to the nozzle insertion part (110) of the decorative panel (11). The connection pipe (87*a*), as shown in FIG. 14, has a pair of circular flange parts (87*c*), (87*d*) formed on a base end side thereof, the flange parts (87*c*), (87*d*) extending outward in the radial direction. A peripheral edge part of an opening (81*c*) formed in the bottom part of the dumper box (81) is sandwiched between these flange parts (87*c*), (87*d*), whereby the connection pipe (87*a*) can be connected to the dumper box (81) in such a way as to be able to turn around its axis. In this way, the connection pipe (87*a*) connected to the dumper box (81) is constructed in such a way as to be able to turn and the connection pipe (87*a*) is connected to the nozzle insertion part (110) with a flexible duct (87*b*) that can be deformed, so that when the indoor unit (3) is installed, even if the direction of the slit part (12*a*) of the suction grill (12) is changed as shown in FIG. 15 when viewed in a bottom plan view, the dumper box (81) can be connected to the nozzle insertion part (110) with reliability. In addition, in the present embodiment, as will be described later, the nozzle insertion part (110) is constructed in such a way as to be able to turn, so that the dumper box (81) can be connected to the nozzle insertion part (110) at the shortest distance with the flexible duct (87*b*). Thus, it is possible to make the length of the flexible duct (87*b*) as short as possible and to freely change the direction of the slit part (12*a*) of the suction grill (12) in accordance with the user's preference.

The carrying duct (88), as shown in FIG. 2 to FIG. 4, has its one end connected to the second end part (67) of the storing part (62) in the duct storage container (60) and has the other end connected to the dust capturing box (90) which will be described later. The dust storage container (60) can be made to communicate with the dust capturing box (90) by this carrying duct (88), whereby the dust can be carried in the carrying duct (88). In other words, a dust carrying passage (96) is formed in the carrying duct (88) and the dust is carried in the dust carrying passage (96). In this regard, the carrying duct (88) is constructed of a flexible tube.

Further, the carrying duct (88) is connected to the dust storage container (60) on the opposite side of a connection portion (communication part) in which the introduction duct (86) and the suction duct (87) are connected to the dust storage container (60). In this way, when the dust is carried, the air blown off from the indoor fan (21) can be smoothly introduced into the dust storage container (60) and the carrying duct (88) via the introduction duct (86), and when the dust is recovered, not only the dust in the dust capturing box (90) but also the dust in the dust storage container (60) can be sucked and recovered together via the suction duct (87). Thus, the construction makes it possible to efficiently carry the dust at the time of carrying the dust and to efficiently recover the dust at the time of recovering the dust.

In the dust carrying device (80) having the construction, in the case of a normal operation in which a cooling/heating operation is performed, the dumper (82) of the dumper box (81) is closed (see FIG. 14A). In this way, the air blown off from the indoor fan (21) is not introduced into the second chamber (81*b*) of the dumper box (81). On the other hand, when the dust in the dust storage container (60) is carried into the dust capturing box (90), the dumper (82) of the dumper box (81) is opened (see FIG. 14B). In this way, a carrying channel for introducing the air blown off from the indoor fan (21) into the dust storage container (60) through the introduction duct (86) and the dumper box (81) is formed. As a result, the dust in the dust storage container (60) is made to flow through the carrying duct (88) and is carried into the dust capturing box (90) along with the introduced air. In other words, as described above, when the dumper (82) in the dumper box (81) is opened, the dust in the dust storage container (60) can be discharged from the dust storage container (60) and can be carried to a specified position by the use of the air blown off from the indoor fan (21).

Still further, in the dust carrying device (80), the dumper (82) of the dumper box (81) is closed also when the dust captured in the dust capturing box (90) is discharged to the outside of the casing (101) (see FIG. 14C). In this case, a suction channel is formed and when air is sucked from the nozzle insertion part (110) by the cleaner, the dust in the dust capturing box (90) is sucked by the cleaner through the carrying duct (88), the dumper box (81), and the suction duct (87).

Thus, as described above, when the dumper (82) as the opening/closing member is provided between the connection position of the introduction duct (86) and the connection position of the suction duct (87) in the dumper box (81) and the dumper (82) is opened or closed, the flow channel of the air can be switched between the carrying channel and the suction channel.

<Nozzle Insertion Part>

Figure 16:
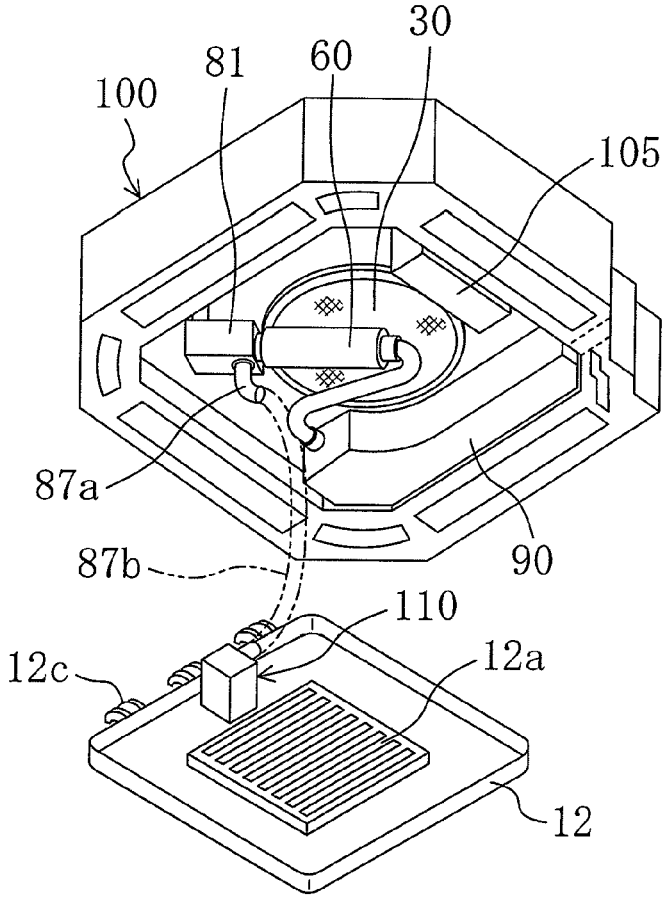
FIG. 16 is a perspective view to schematically show a connection relationship between a dumper box and a nozzle insertion part.

Next, the nozzle insertion part (110) to which the suction duct (87) is connected will be described below in detail on the basis of FIG. 16 to FIG. 22. The nozzle insertion part (110) is provided outside the slit part (12*a*) of the suction grill (12). Specifically, as shown in FIG. 16, the suction grill (12) formed nearly in a rectangular shape when viewed in a plan view has a hinge part (12*c*) provided on its one side, the hinge part (12*c*) being a part in which the suction grill (12) is connected to the decorative panel (11). The nozzle insertion part (110) is provided near the hinge part (12*c*). Moreover, the nozzle insertion part (110) is provided nearly at the center in a width direction of the one side of the suction grill (12). The nozzle insertion part (110) is provided on the side near to the hinge part (12*c*) outside the slit part (12*a*) of the suction grill (12), so that the length of the flexible duct (87*b*) connected to the nozzle insertion part (110) can be made shorter as compared with a case where the nozzle insertion part (110) is provided on a position other than that position of the suction grill (12). In other words, when the suction grill (12) is opened, in the case where the nozzle insertion part (110) is located on the side near to the hinge part (12*c*) of the suction grill (12), the distance from the nozzle insertion part (110) to the dumper box (81) can be made shorter and hence the necessary length of the flexible duct (87*b*) can be made shorter.

Further, as described above, the nozzle insertion part (110) is provided nearly at the center in the width direction of the suction grill (12), so that even when the position where suction grill (12) is fixed is changed (see FIG. 16 and FIG. 18A), as will be described later, the distance from the dumper box (81) to the nozzle insertion part (110) can be made the same and hence the length of the flexible duct (87*b*) connected to the nozzle insertion part (110) can be made as short as possible.

Figure 17:
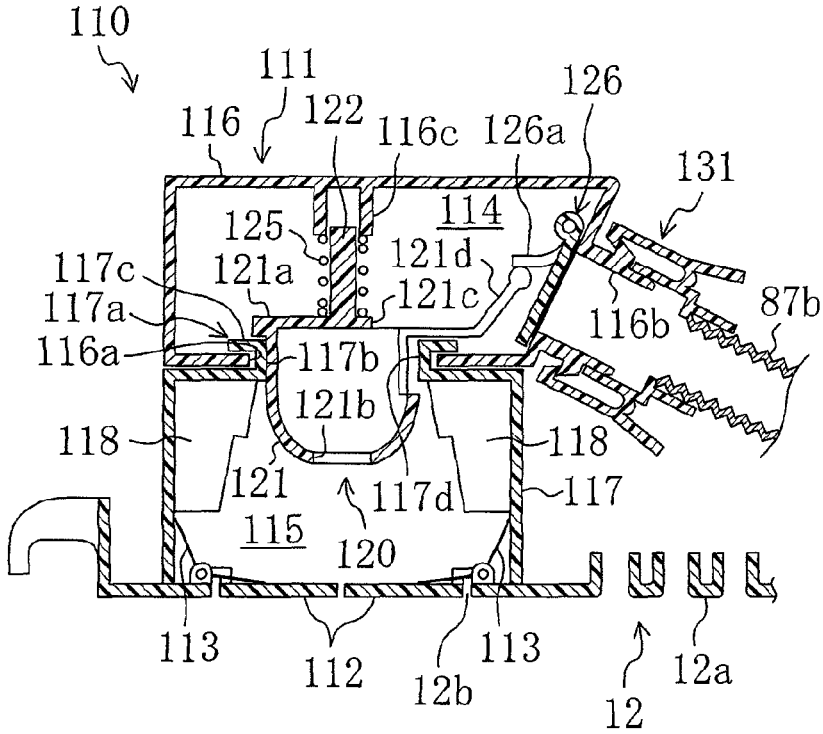
FIGS. 17A and 17B are longitudinal section views to show a construction of the nozzle insertion part.
Figure 17:
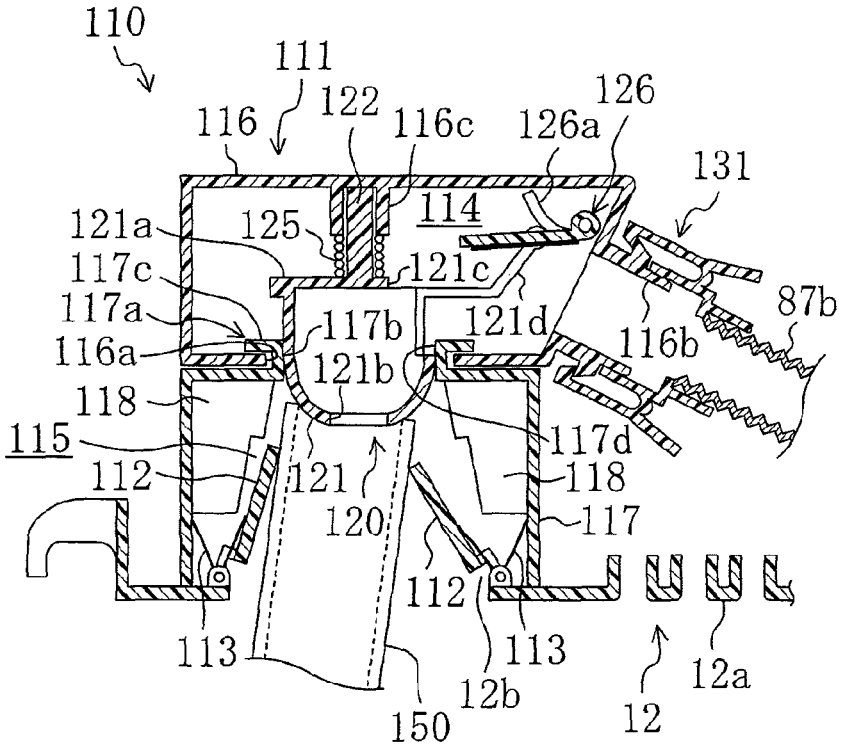

The nozzle insertion part (110), as shown in FIG. 17, is provided with a box-shaped cover member (111) placed on the reverse side of the ceiling of the suction grill (12). This cover member (111) is made of an upper cover (116) (upper cover member) formed in the shape of a rectangular solid and a lower cover (117) (lower cover member) formed in the shape of a box that is open downward, the upper cover (116) and the lower cover (117) being vertically connected to each other. The upper cover (116) has a first space (114) formed therein and the lower cover (117) has a second space (115) formed therein, respectively.

Further, the upper cover (116) is turnably connected to the lower cover (117). Specifically, the upper cover (116) has a circular opening (116*a*) formed in its bottom surface whereas the lower cover (117) has an engaging part (117*a*) formed in its upper surface, the engaging part (117*a*) being engaged with a peripheral edge part of the opening (116*a*). Thus, the upper cover (116) can be turned with respect to the lower cover (117) in the state where the peripheral edge part of the opening (116*a*) is engaged with the engaging part (117*a*). In other words, the engaging part (117*a*) of the lower cover (117) includes a cylindrical main part (117*b*), which protrudes upward from the top surface of the lower cover (117) in correspondence to the opening (116*a*) of the upper cover (116), and a protruding part (117*c*) which is formed on the protruding end side of the main part (117*b*) in such a way as to protrude outward in the radial direction. As shown in FIG. 17, the peripheral edge part of the opening (116*a*) formed in the bottom surface of the upper cover (116) is sandwiched between the protruding part (117*c*) and the top surface of the lower cover (117), whereby the upper cover (116) can be turnably engaged with the lower cover (117). In this regard, although not shown in the drawing, the upper cover (116) is divided in the width direction (in a direction along the surface of the paper in FIG. 17), so that when the upper cover (116) is combined with the lower cover (117), it is only required that the upper cover (116) is combined with the lower cover (117) in such a way as to sandwich the engaging part (117*a*) of the lower cover (117) between the divided parts of the upper cover (116).

Figure 18:
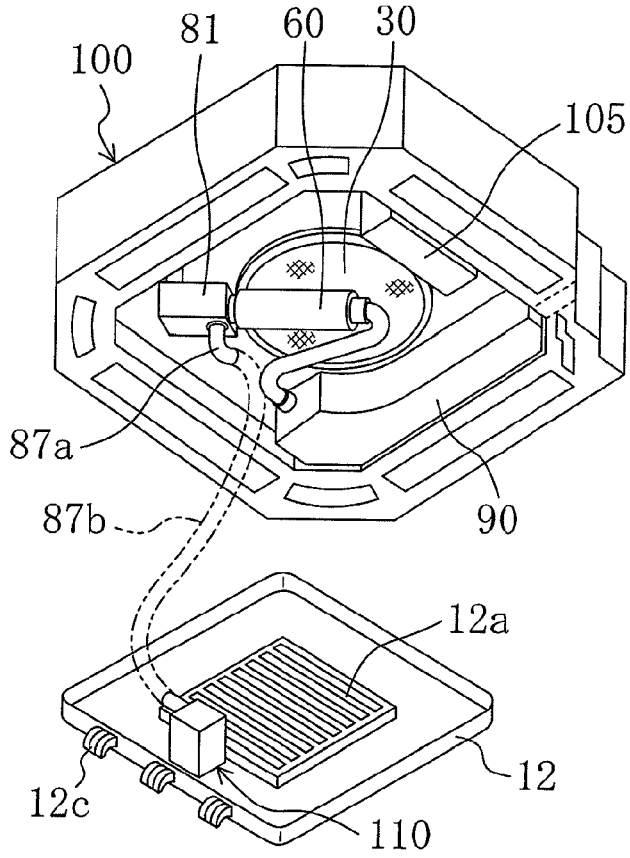
FIGS. 18A and 18B are views corresponding to FIG. 16 and FIG. 17 when a suction grill is mounted at an angle different from the case shown in FIG. 16.
Figure 18:
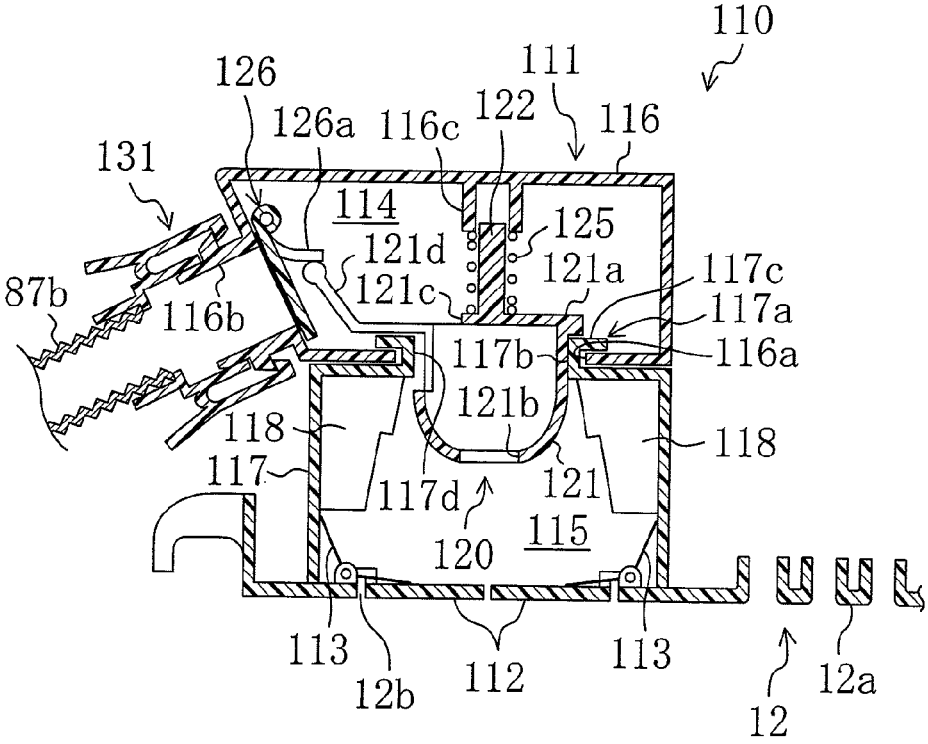

In this way, the upper cover (116) and the lower cover (117) are turnably connected to each other, so that even when the slit part (12*a*) of the suction grill (12) is turned in some other direction as shown in FIG. 18, if the upper cover (116) is turned with respect to the lower cover (117) as shown in FIG. 18, the suction duct (87) can be reliably connected to the nozzle insertion part (110) at a distance as short as possible.

One side of the upper cover (116) is formed on the slant in such a way that a part closer to its top is located further outward. The one side has a duct opening (116*a*) formed therein, the duct opening (116*a*) being open obliquely downward. The duct opening (116*b*) has the other end side of the flexible duct (87*b*) of the suction duct (87) removably connected thereto, as will be described later. The duct opening (116*b*) is covered with a valve body (126) from inside the upper cover (116). The valve body (126) is turnably supported by the upper cover (116) at a top end thereof and is provided with a protruding part (126*a*) protruding to the inside of the upper cover (116) from the top end. As will be described later in detail, the protruding part (126*a*) contacts a part of a piston member (120) and the valve body (126) is opened or closed by the up and down movement of the piston member (120).

The suction grill (12) has an opening (12*b*) formed therein in correspondence to the lower cover (117). Two plate-shaped cover members (covers) (112), (112) are provided side by side in a line in the opening (12*b*) and are fixed to the lower cover (117) in such a way as to turn upward around inside edge parts opposite to each other of the opening (12*b*). In other words, the cover members (112) are provided in the opening (12*b*) in such a way as to doubly open upward. Moreover, a spring member (113) is provided between the turning center side of the cover member (112) and the inside surface of the lower cover (117), and the cover member (112) is urged in a closing direction by the spring member (113). In this way, as shown in FIG. 17A, in a state in which the nozzle (150) of the cleaner is not inserted, the cover members (112) can be always set in a closed state, which can make the interior of the nozzle insertion part (110) hard to see from inside the chamber and can prevent the dust from flowing into the chamber.

The inside part of the cylindrical main part (117*b*) in the engaging part (117*a*) of the lower cover (117) constructs an insertion hole (117*d*) through which a nozzle connection part (121) of the piston member (120) which will be described later is inserted. In other words, the main part (117*b*) of the engaging part (117*a*) functions as a guide when the nozzle connection part (121) moves in a sliding manner. This construction can smoothly move up and down the nozzle connection part (121), that is, the piston member (120).

The piston member (120) includes a nozzle connection part (121) on which the nozzle (150) of the cleaner contacts and a shaft part (122) which is formed above the nozzle connection part (121) and integrally with the nozzle connection part (121). The nozzle connection part (121) is formed in a semi-spherical shape protruding to the inside of the chamber and has its upper side covered with a plate part (121*a*). The nozzle connection part (121) has an opening (121*b*) formed in a protruding end part thereof. In this way, even the nozzle (150) of the cleaner which is different in the shape of cross section and in size can be made to reliably contact the nozzle connection part (121) to suck and recover the dust through the opening (121*b*).

Figure 19:
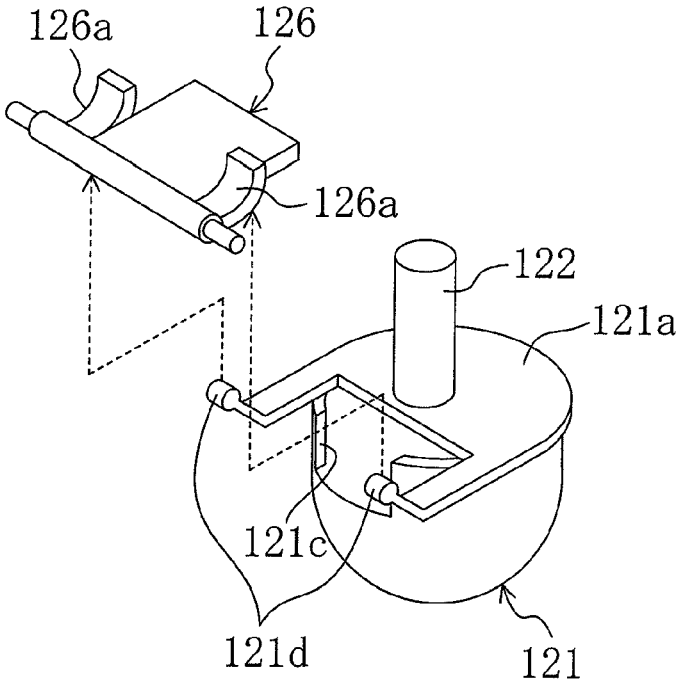
FIG. 19 is a perspective view to show a construction of a nozzle connection part and a valve body.

The nozzle connection part (121) has its interior made hollow and, as shown in FIG. 19, has an opening (121*c*) formed in a part on its base end side (upper side in the drawing). The opening (121*c*) is formed in such a way as to be open obliquely upward from the base end side of the semi-spherical part of the nozzle connection part (121) to a part of the plate part (121*a*). Contacting parts (121*d*) extending obliquely upward from the plate part (121*a*) are formed on the left and right sides of the opening (121*c*). The contacting parts (121*d*) are formed in such a way as to contact protruding parts (126*a*) formed on the valve body (126) covering a duct opening (116*b*) of the upper cover (116) from inside the upper cover (116). In other words, the protruding parts (126*a*) of the valve body (126) are formed on both sides in the width direction of the valve body (126) and are formed in such a way as to curve upward, so that when the nozzle connection part (121) is moved upward, the protruding parts (126*a*) of the valve body (126) are pushed upward by the contacting parts (121*d*) of the nozzle connection part (121). In this way, as shown in FIG. 17B, the valve body (126) can be set in an open state. In this regard, the contacting parts (121*d*) are constructed in such a way that when the upper cover (116) turns with respect to the lower cover (117), the contacting parts (121*d*) contact the side surface of the upper cover (116) and turn along with the upper cover (116). Thus, when the upper cover (116) turns, the piston member (120) also turns.

The shaft part (122) is integrally formed in such a way as to extend upward above the plate part (121*a*) of the nozzle connection part (121). The top end of the shaft part (122) is located inside the cylindrical guide part (116*c*) formed inside the top surface of the upper cover (116), whereby the nozzle connection part (121) can be moved more smoothly in the up and down direction. Moreover, a spring member (125) is arranged on the outer peripheral side of the shaft part (122) in such a way as to be sandwiched between the bottom end of the guide part (116*c*) and the plate part (121*a*) of the nozzle connection part (121). The spring member (125) is constructed in such a way as to bias the nozzle connection part (121) downward (to the lowest position) and is constructed in such a way as to allow the nozzle connection part (121) to move upward when the nozzle (150) of the cleaner is pressed onto the nozzle connection part (121) from below. In this regard, the nozzle connection part (121) is constructed in such a way that the outer peripheral part of the plate part (121*a*) contacts the protruding part (117*c*) of the engaging part (117*a*) of the lower cover (117) in a state where the nozzle connection part (121) is biased downward by the spring member (125).

Thus, in this construction, when the nozzle (150) of the cleaner is pressed to the nozzle connection part (121) from below, the nozzle connection part (121) is moved up against the biasing force of the spring member (125) and hence the opening (121*c*) formed in the nozzle connection part (121) is fully opened toward the first space (114) in the upper cover (116). Moreover, when the nozzle connection part (121) is moved up, the contacting parts (121*d*) formed on the left and right sides of the opening (121*c*) of the nozzle connection part (121) push up the protruding parts (126*a*) of the valve body (126) covering the duct opening (116*b*) of the upper cover (116) from inside the upper cover (116) to thereby set the valve body (126) in an open state. Then, the suction duct (87) and the inner space of the nozzle connection part (121) are set in a communicating state through the dust opening (116*b*).

In other words, when the nozzle connection part (121) is displaced upward, the inner space of the nozzle connection part (121) is made to communicate with the interior of the dust capturing box (90) through the opening (121*c*) formed in the nozzle connection part (121), the first space (114) in the upper cover (116), the suction duct (87), the dumper box (81), the dust storage container (60), and the carrying duct (88). When the cleaner is operated in this state, the dust stored in the dust capturing box (90) is sucked into the nozzle (150) of the cleaner by the suction force of the cleaner through the carrying duct (88), the dust storage container (60), the dumper box (81), the suction duct (87), the first space (114) of the cover member (111), and the nozzle connection part (121).

On the other hand, in a state where the nozzle connection part (121) is not pushed up by the nozzle (150) of the cleaner, the nozzle connection part (121) is biased down by the spring member (125), so that as shown in FIG. 17A, the valve body (126) of the duct opening (116*b*) is not held up by the contacting parts (121*d*) of the nozzle connection part (121) but sets the duct opening (116*b*) in a closed state. In this way, the nozzle connection part (121) and the suction duct (87) are set in a non-communicating state, which can prevent the dust from flying into the room.

In this regard, the lower cover (117) has nozzle guide parts (118) provided on the inner side surface and the inner top surface thereof, the nozzle guide parts (118) making the nozzle (150) of the cleaner contact the nozzle connection part (121) with reliability. This nozzle guide part (118) is a plate-shaped part so formed as to spread on the inner side surface and the inner top surface of the lower cover (117). Two nozzle guide parts (118) are provided on each side of the top surface of the lower cover (117) formed in the shape of a rectangular solid.

Figure 20:
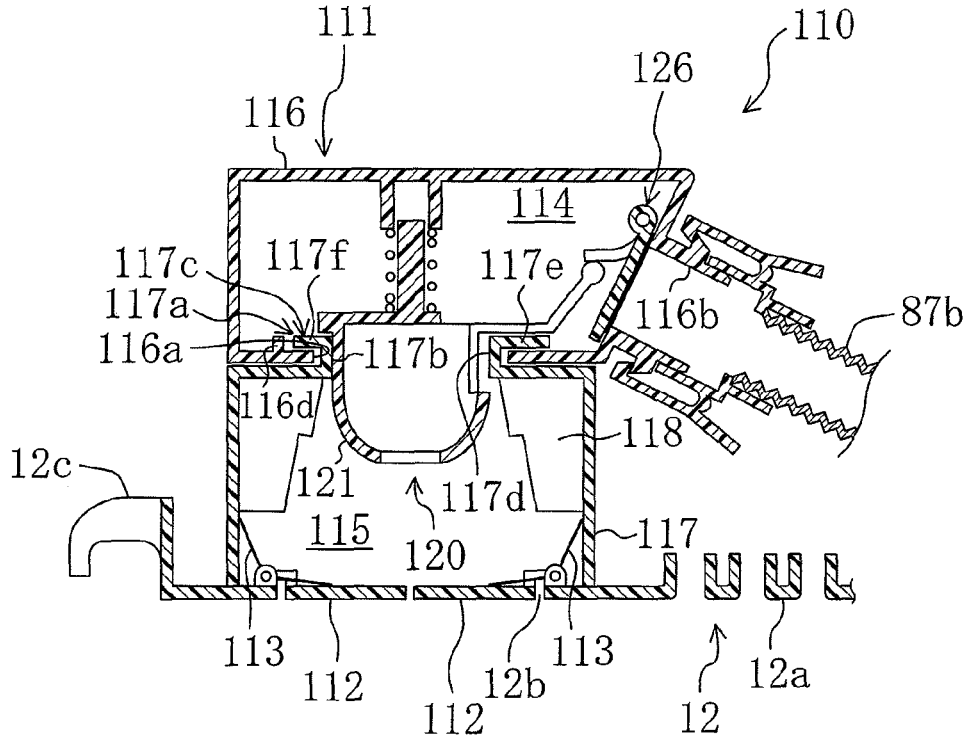
FIG. 20 is an enlarged section view of the nozzle insertion part in which a pin part of an upper cover and a protruding part of a lower cover are shown together.
Figure 21:
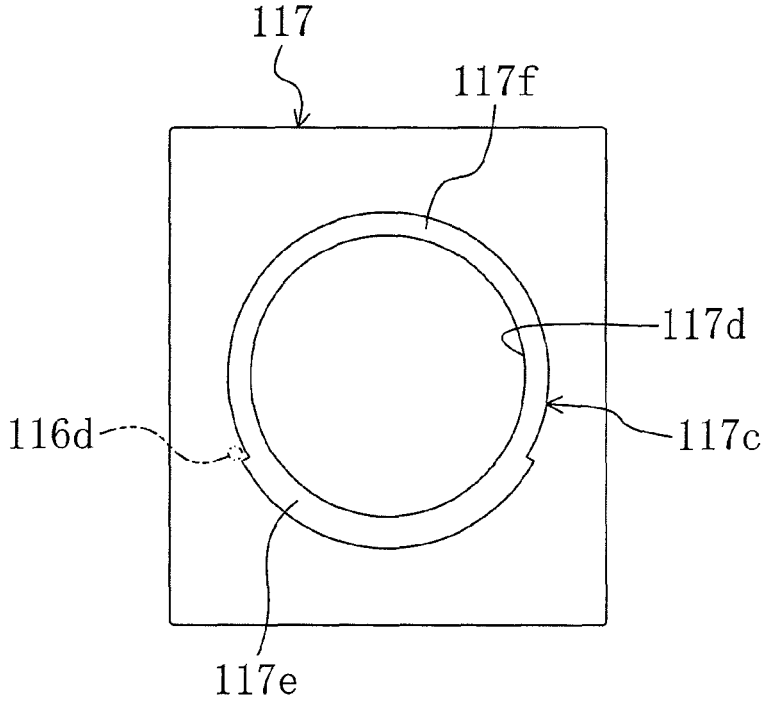
FIG. 21 is a plan view of the lower cover.

Moreover, as shown in FIG. 20 and FIG. 21, the protruding part (117*c*) of the lower cover (117) of the nozzle insertion part (110) is formed in a larger outside diameter within a specified angle range in a peripheral direction. In other words, the protruding part (117*c*) is formed of a large diameter part (117*e*) having a larger outside diameter and a small diameter part (117*f*) having a smaller outside diameter (see FIG. 21). On the other hand, a pin part (116*d*) is formed inside the bottom surface of the upper cover (116) in such a way that the position of the upper cover (116) from a rotational center is located inside the large diameter part (117*e*) of the protruding part (117*c*) and outside the small diameter part (117*f*) of the protruding part (117*c*) in a state where the upper cover (116) is combined with the lower cover (117). In this way, when the upper cover (116) is turned with respect to the lower cover (117), the pin part (116*d*) of the upper cover (116) contacts a stepped part between the small diameter part (117*f*) and the large diameter part (117*e*) of the lower cover (117), whereby the upper cover (116) is prevented from turning (see FIG. 21). In other words, when the pin part (116*d*) of the upper cover (116) is located outside the small diameter part (117*f*) of the protruding part (117*c*) constructing the engaging part (117*a*) of the lower cover (117), the upper cover (116) is allowed to turn. On the other hand, when the pin part (116*d*) contacts the stepped part between the small diameter part (117*f*) and the large diameter part (117*e*) of the protruding part (117*c*) of the lower cover (117), the upper cover (116) is prevented from turning.

The construction described above can prevent the upper cover (116) of the nozzle insertion part (110) from turning a specified angle or more. This can prevent the flexible duct (87*b*) connected to the upper cover (116) from being brought into in a bent state. In other words, the nozzle insertion part (110) is provided on the suction grill (12), so that depending on the turning angle of the upper cover (116) of the nozzle insertion part (110), there is a possibility that when the suction grill (12) is closed, the flexible duct (87*b*) connected to the upper cover (116) is received in a bent state. This greatly impairs the flow of air and dust in the flexible duct (87*b*) and presents also the possibility of doing harm to the flexible duct (87*b*). In contrast to this, when the turning range of the upper cover (116) is limited within an angle range in which the flexible duct (87*b*) is not bent even if the suction grill (12) is closed, the flexible duct (87*b*) can be prevented from being brought into the bent state.

In this regard, in the case of the construction shown in FIG. 20, the nozzle insertion part (110) is provided near the hinge parts (12*c*) of the suction grill (12), so that the turning range of the upper cover (116) is set within an angle range excluding an angle range from +60 to −60 degrees (total 120 degrees) with a center at the duct opening (116*b*) in the state where the duct opening (116*b*) is directed to one side of the suction grill (12), the one side being provided with the hinge parts (12*c*). In other words, the upper cover (116) can be turned within an angle range of 180 degrees±30 degrees with a center at the duct opening (116*b*) in the state where the duct opening (116*b*) is directed opposite to the one side of the suction grill (12), the one side being provided with the hinge parts (12*c*). In this way, the upper cover (116) is constructed in such a way as to turn more than 180 degrees, so that depending on the angle position of the upper cover (116), the flexible duct (87*b*) connected to the upper cover (116) can be pressed into the cleaning unit (100) and hence the suction grill (12) can be easily closed without being interfered with the flexible duct (87*b*).

Figure 22:
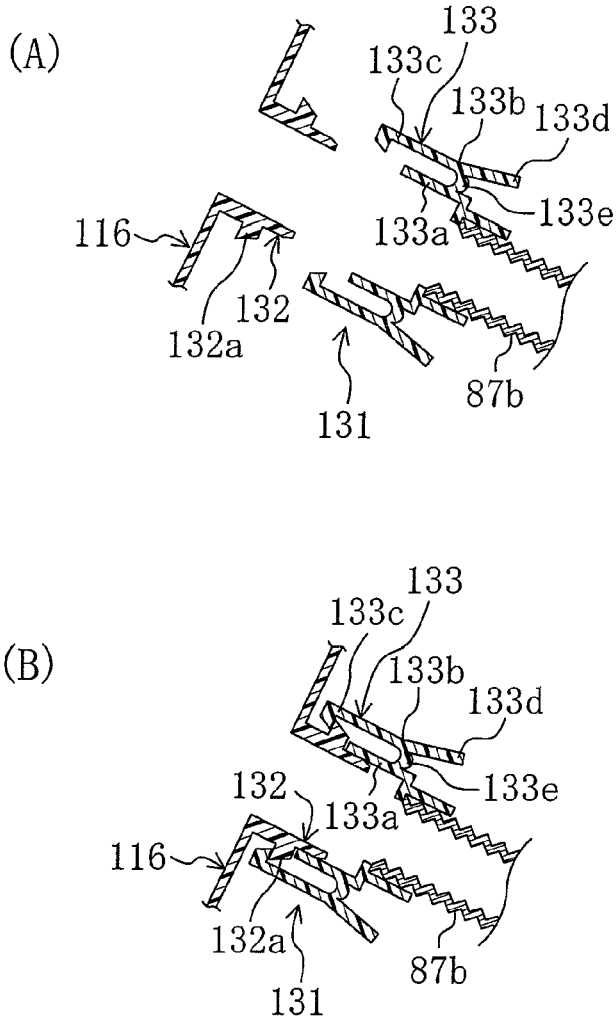
FIGS. 22A and 22B are enlarged section views to show a connection portion of the nozzle insertion part and a flexible duct in an enlarged manner.

Here, the connection structure of the flexible duct (87*b*) will be described below in detail. As shown in FIG. 22 in a connection portion (131) in which the flexible duct (87*b*) is connected to the nozzle insertion part (110), the upper cover (116) of the nozzle insertion part (110) is provided with a first connection part (132) whereas an end of the flexible duct (87*b*) corresponding to the first connection part (132) is provided with a second connection part (133), and the first connection part (132) is engaged with the second connection part (133).

The first connection part (132) has a protruding part (132*a*) formed thereon, the protruding part (132*a*) protruding over the whole outer peripheral surface of a part nearly shaped like a cylinder. An engaging part (133*c*), which will be described later, of the second connection part (133) is engaged with the protruding part (132*a*).

The second connection part (133) has a main part (133*a*) formed of a part nearly shaped like a cylinder having a larger diameter than the first connection part (132) and has a claw part (133*b*) integrally formed on its outer peripheral surface. This claw part (133*b*) includes a cylindrical engaging part (133*c*), which is extended outward in an axial direction of the flexible duct (87*b*) and is engaged with the protruding part (132*a*) of the first connection part (132), a lever part (133*d*) shaped like a protruding part and extended in a direction opposite to the engaging part (133*c*), and an elastically deformable part (133*e*) which elastically connects the engaging part (133*c*) and the lever part (133*d*) to the main part (133*a*) at its middle part. The lever part (133*d*) is formed in such a way that a part closer to its tip is located further outward in the radial direction. With this construction, when the lever part (133*d*) is displaced inward in the radial direction, the elastically deformable part (133*e*) is deformed to displace the engaging part (133*c*) outward in the radial direction, the engaging part (133*c*) extending in a direction opposite to the lever part (133*d*). On the other hand, when the lever part (133*d*) is returned to an original position, the engaging part (133*c*) is returned to its original position by the elastic restoring force of the elastically deformable part (133*e*).

Thus, in the case where the engaging part (133*c*) of the second connection part (133) is engaged with the protruding part (132*a*) of the first connection part (132), when the engaging part (133*c*) contacts the protruding part (132*a*), the elastically deformable part (133*e*) for elastically supporting the engaging part (133*c*) is elastically deformed to displace the engaging part (133*c*) outward in the radial direction, whereby the engaging part (133*c*) can be engaged with the protruding part (132*a*) (see FIG. 22B). On the other hand, in the case where the second connection part (133) is disengaged from the first connection part (132), the lever part (133*d*) is deformed inward in the radial direction to displace the engaging part (133*c*) outward in the radial direction, which separates the engaging part (133*c*) from the protruding part (132*a*) of the first connection part (132) to disengage the engaging part (133*c*) from the protruding part (132*a*).

This construction makes it possible to easily insert or eject the flexible duct (87*b*) into or from the nozzle insertion part (110) and hence to improve workability at the time of maintenance and the like.

<Maintenance Structure>

A construction for making an access to the electric component box (20) in a state where the cleaning unit (100) is mounted in the main unit (10) at the time of maintaining the electric component box (20) of the main unit (10) will be described below.

Figure 23:
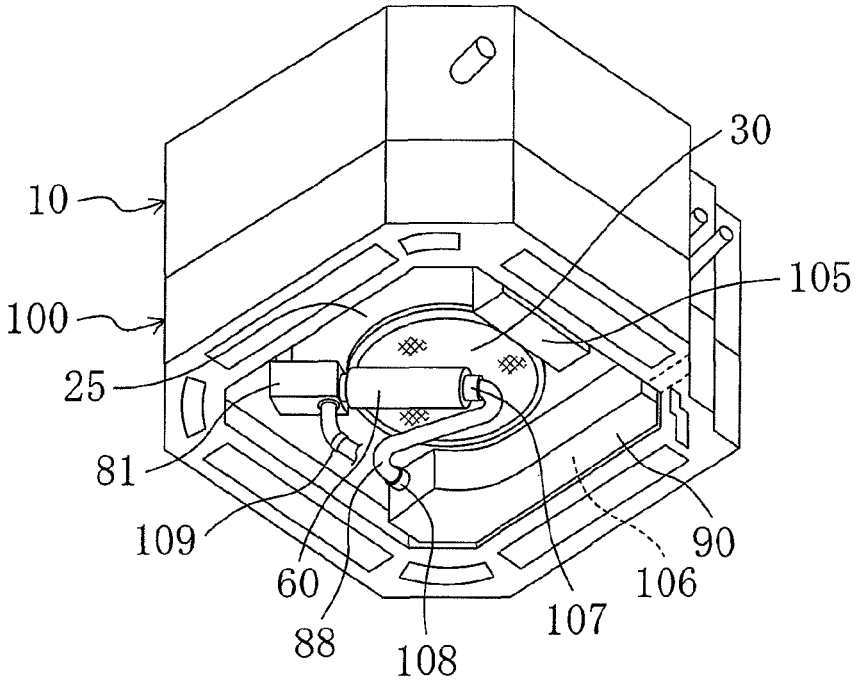
FIG. 23 is a perspective view to show a state in which the main unit is combined with a cleaning unit.
Figure 24:
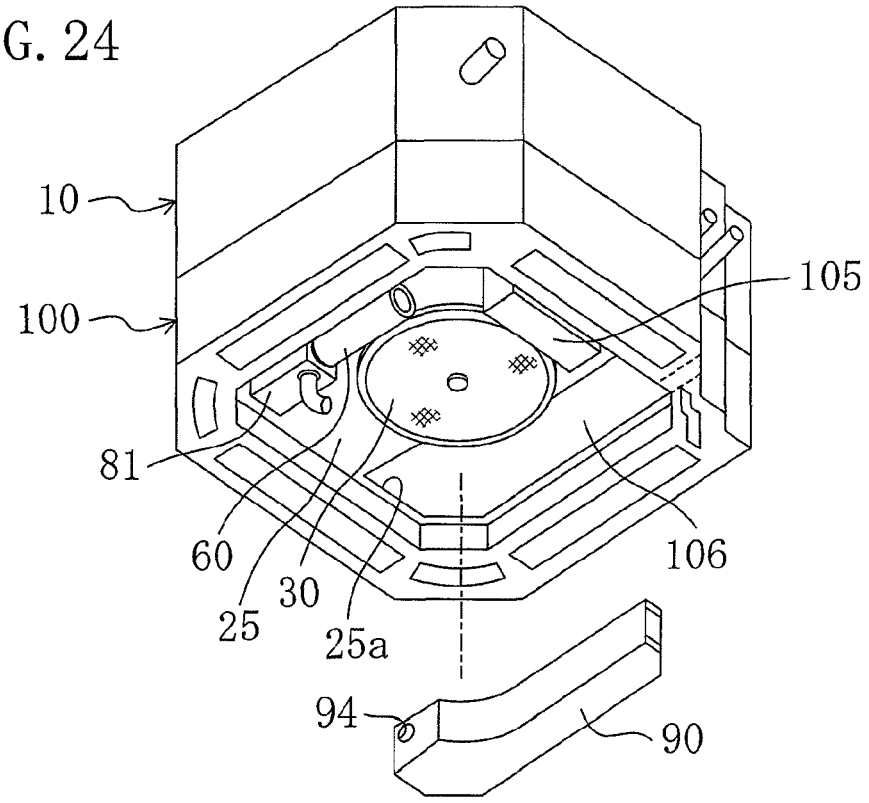
FIG. 24 is a perspective view to show a state in which a dust capturing box is dismounted from the interior of the cleaning unit.
Figure 25:
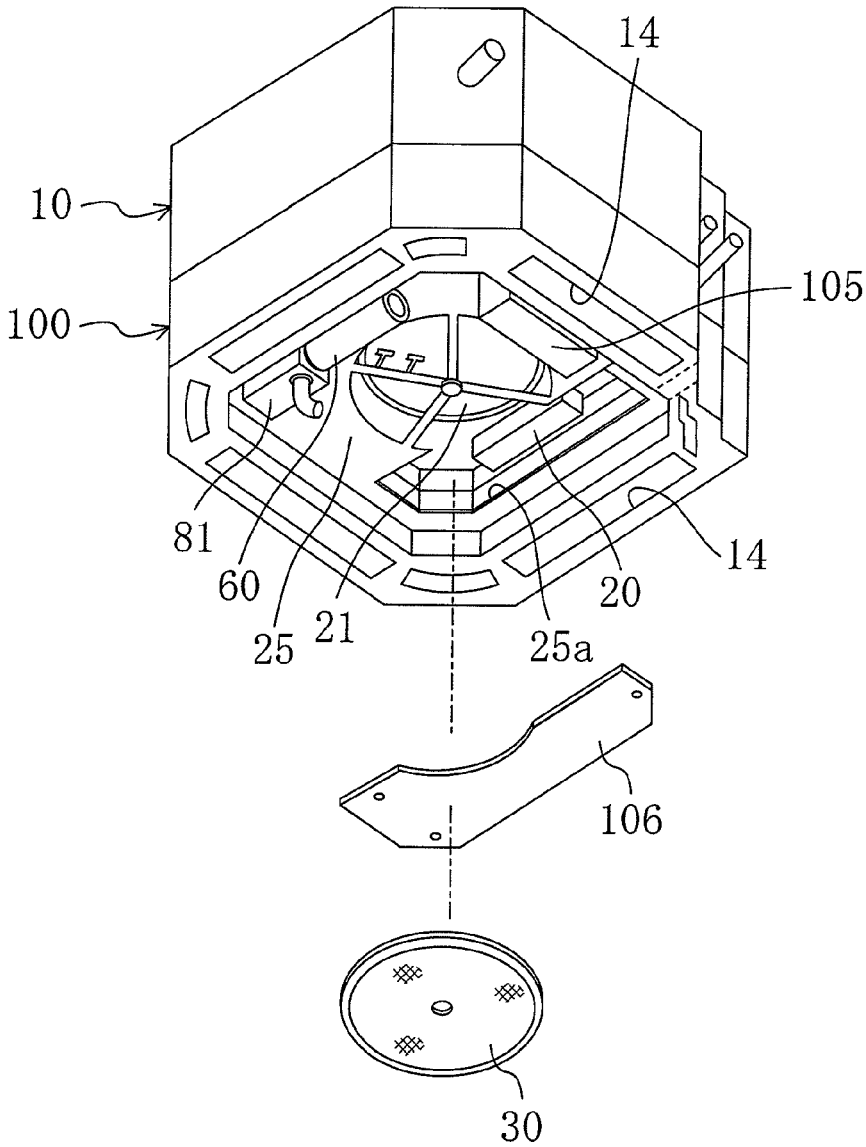
FIG. 25 is a perspective view to show a state in which the air filter and a service cover are dismounted from the interior of the cleaning unit.

Specifically, as shown in FIG. 23 to FIG. 25, the cleaning unit (100) is constructed in such a way that the air filter (30) and the service cover (106) can be dismounted, and the service cover (106) and the electric component box (20) are provided at a position where when the service cover (106) is dismounted, an access to the electric component box (20) of the main unit (10) can be made.

More specifically, as described above, the dust storage container (60) and the dumper box (81) are constructed in such a way as to turn around the axis of the introduction duct (86) connected to the dumper box (81). In this way, when the air filter (30) is dismounted, the dust storage container (60) and the dumper box (81) can be moved to the side of the air filter (30) (see FIG. 24).

In this regard, when the dust storage container (60) and the dumper box (81) are turned, the carrying duct (88) for connecting the dust storage container (60) to the dust capturing box (90) and the suction duct (87) (flexible duct (87*b*)) for connecting the dumper box (81) to the nozzle insertion part (110) of the decorative panel (11) need to be removed. Thus, in order to easily attach and remove the carrying duct (88) and the flexible duct (87*b*), the same construction (see FIG. 22) that is employed for the connection portion (131) in which the flexible duct (87*b*) is connected to the nozzle insertion part (110) is employed for a connection portion (107) in which the carrying duct (88) is connected to the dust storage container (60), a connection portion (108) in which the carrying duct (88) is connected to the dust capturing box (90), and a connecting portion (109) (connection pipe (87*a*)) in which the flexible duct (87*b*) is connected to the dumper box (81).

Moreover, the dust capturing box (90) in the cleaning unit (100) is constructed in such a way as to be mounted on and dismounted from the cleaning unit (100), and when the dust capturing box (90) is dismounted, the service cover (106) arranged above the dust capturing box (90) is exposed. The service cover (106) is also constructed in such a way as to be dismounted and, as shown in FIG. 25, when the air filter (30) and the service cover (106) are dismounted in this order, the electric component box (20) in the main unit (10) is exposed and the maintenance work of the electric component box (20) can be easily performed.

—Operating Action—

Next, an operating action in the indoor unit (3) will be described with reference to FIG. 11 and FIG. 14. The indoor unit (3) is constructed in such a way as to switch between a normal operation for performing a cooling and heating operation and a filter cleaning operation for cleaning the air filter (30).

<Normal Operation>

In the normal operation, the rotary brush (51) is rotated to locate its brush (51*b*) to the side of the cleaning brush (52). In other words, the rotary brush (51) is rotated to a position where the brush (51*b*) of the rotary brush (51) is not in contact with the air filter (30) and the non-brush surface (that is, the outer peripheral surface of the shaft (51*a*) not provided with the brush (51*b*)) of the rotary brush (51) is faced to the air filter (30). Moreover, the dumper (82) of the dumper box (81) is set in a closed state (state shown in FIG. 14A). In this regard, the air filter (30) is set in a stop state where the air filter (30) is not rotated.

In this state, the indoor fan (21) is driven. Then, in the indoor unit (3), indoor air sucked from the suction port (13) passes through the air filter (30) and flows into the bell mouth (24). When the air passes through the air filter (30), dust in the air is captured by the mesh member (37) of the air filter (30). The air having flown into the bell mouth (24) is blown off from the indoor fan (21). This blown-off air exchanges heat with refrigerant in the indoor heat exchanger (22), thereby being cooled or heated, and then is supplied into a room from each blowoff port (14). In this way, the room is cooled or heated. In this operation, the dumper (82) of the dumper box (81) is closed, so that the air blown off from the indoor fan (21) is not introduced into the dust storage container (60) through the dumper box (81).

In this way, in the normal operation, the brush (51*b*) of the rotary brush (51) is not in contact with the air filter (30). In other words, the brush (51*b*) is separated from the air filter (30). Thus, this can prevent the brush (51*b*) from being in continuous contact with the air filter (30) to prevent the brush (51*b*) from deteriorating. This can improve the durability of the rotary brush (51).

<Filter Cleaning Operation>

In the filter cleaning operation, in the refrigerant circuit shown in FIG. 1, the compressor (4) is stopped to bring about a state where the refrigerant is not circulated. This filter cleaning operation is constructed in such a way as to switch among "a dust removing operation", "a brush cleaning operation", "a dust carrying operation", and "a dust discharging operation". In this regard, the LED (16) arranged on the decorative panel (11) is turned on during "the dust removing operation", "the brush cleaning operation", and "the dust carrying operation". This can inform a user that these operations are being performed.

"The dust removing operation" is the operation of removing dust captured by the air filter (30). "The brush cleaning operation" is the operation of removing dust captured by the rotary brush (51). "The dust carrying operation" is the operation of carrying dust from the dust storage container (60) to the dust capturing box (90). "The dust discharging operation" is the operation of discharging dust from the dust capturing box (90) to the outside of the indoor unit (3).

In the present embodiment, "the dust removing operation" and "the brush cleaning operation" are alternately performed. First, in "the dust removing operation", the indoor fan (21) is stopped. Then, the brush (51*b*) of the rotary brush (51) is brought into contact with the air filter (30). In this state, the air filter (30) is rotationally moved in such a way as to reversely stand the piles of the brush (51*b*) of the rotary brush (51) (in the direction shown by a blank arrow in FIG. 11A). At this time, the rotary brush (51) is held stopped.

Then, the dust on the air filter (30) is captured by the brush (51*b*) of the rotary brush (51) (see FIG. 11A). Then, the lever (44*a*) of the limit switch (44) of the filter driving means (40) is activated, the filter driving motor (41) is stopped to stop the rotation of the air filter (30). In other words, the air filter (30) is rotated by a specified angle and then is stopped. Thus, the dust in a region in which the air filter (30) is brought into contact with the brush (51*b*) of the rotary brush (51) is removed. Here, the brush (51*b*) has their piles implanted on the slant in such a way that the piles stand against the rotational direction of the air filter (30) (direction to which the air filter (30) is moved), so that the dust on the air filter (30) can be easily scrapped off by the brush (51*b*). Thus, this can improve the efficiency of removing dust by the rotary brush (51). As described above, when the rotation of the air filter (30) is stopped, "the dust removing operation" is switched to the "the brush cleaning operation".

In "the brush cleaning operation", in the state where the indoor fan (21) is continuously held stopped, first, the rotary brush (51) is rotated in the left direction (counterclockwise) in FIG. 11. At that time, the rotary brush (51) is rotated with the dust captured on the brush (51*b*) in such a way that the brush part (51*b*) is brought into contact with the brush part (52*b*) of the cleaning brush (52) (see FIG. 11B). The rotary brush (51) is rotated by a specified rotational angle and then is stopped.

Thereafter, the rotary brush (51) is rotated in the direction opposite to the rotational direction described above (in the right direction in FIG. 11 (clockwise)). Then, the dust captured by the brush (51*b*) of the rotary brush (51) is removed by the brush (52*b*) of the cleaning brush (52) (see FIG. 11C). This is because the piles of the brush (52*b*) of the cleaning brush (52) are implanted downward, that is, on the slant in such a way as to reversely stand up by the clockwise rotation of the rotary brush (51), whereby the dust attached to the brush (51*b*) of the rotary brush (51) can be scraped off by the cleaning brush (52).

Moreover, the brush part (51*b*) of the rotary brush (51) is brought into contact with the brush part (52*b*) of the cleaning brush (52), whereby the main part (52*a*) of the cleaning brush (52) is pressed in a direction separated from the rotary brush (51). However, the main part (52*a*) is biased to the rotary brush (51) by the spring part (52*c*), so that their brush parts (51*b*) and (52*b*) are not separated from each other but the cleaning brush (52) is suitably pressed onto the rotary brush (51). Thus, the brush (52*b*) of the cleaning brush (52) removes the dust from the brush (51*b*) of the rotary brush (51) with more reliability and can capture the dust. In this regard, the rotary brush (51) is rotated to a position of its original state (state shown in FIG. 11A) and is stopped at the position.

Subsequently, the rotary brush (51) is again rotated by a specified rotational angle in the left direction (counterclockwise). Then, the dust captured by the brush (52*b*) of the cleaning brush (52) is scraped off by the brush (51*b*) of the rotary brush (51) and is dropped in the storing part (62) of the dust storage container (60) (see FIG. 11D). In other words, the piles of the brush (51*b*) of the rotary brush (51) slant in the rotational direction and hence can scrape off the dust from the brush (52*b*) of the cleaning brush (52). Also at that time, the cleaning brush (52) is suitably pressed onto the rotary brush (51) by the spring part (52*c*), so that the brush (51*b*) of the rotary brush (51) can remove the dust from the cleaning brush (52) with more reliability.

As described above, the dust captured by the rotary brush (51) is removed and stored in the storing part (62) of the dust storage container (60). Thereafter, the rotary brush (51) is again rotated in the right direction (clockwise) and is returned to the original state (shown in FIG. 11A). In this way, "the brush cleaning operation" is once finished.

When "the brush cleaning operation" described above is finished, "the dust removing operation" described above is again performed. In other words, the air filter (30) is rotated again and when the lever (44*a*) of the limit switch (44) is again activated, the air filter (30) is stopped. In this way, in the air filter (30), the dust in a region passing the brush (51*b*) of the rotary brush (51) is captured by the brush (51*b*) of the rotary brush (51) (see FIG. 11A). In this way, when "the dust removing operation" and "the brush cleaning operation" are performed alternately and repeatedly, the dust can be removed for each specified region of the air filter (30). Then, when the dust is removed for the whole region of the air filter (30), "the dust removing operation" and "the brush cleaning operation" are completely finished. For example, when the lever (44*a*) of the limit switch (44) is activated by specified times, it is judged that the air filter (30) is rotated by one revolution and the operations are finished.

In this regard, at the time of "the dust removing operation" and "the brush cleaning operation", the amount of dust stored in the dust storage container (60) is detected by the storage amount detecting means (70). In other words, the luminous intensity of light by the light emitting diode LED (72) is detected by a phototransistor (73). When the luminous intensity detected by the phototransistor (73) becomes a set value (lower limit value) or less, it is judged that the amount of dust stored in the dust storage container (60) reaches a specified amount and the operation is switched to "the dust carrying operation".

In "the dust carrying operation", the rotary brush (51) is stopped in the state shown in FIG. 11A and the air filter (30) is set in a stop state. Moreover, the dumper (82) of the dumper box (81) is set in an open state (state shown in FIG. 14B). When the indoor fan (21) is driven in this state, the air blown off from the indoor fan (21) is introduced into the dust storage container (60) through the introduction duct (86) and the dumper box (81). In this way, the dust in the dust storage container (60) is carried into the dust capturing box (90) together with the air through the carrying duct (88). Then, the amount of dust stored in the dust storage container (60) is decreased to make the luminous intensity detected by the phototransistor (73) higher. Then, when the detected luminous intensity becomes a set value (upper limit value) or more, it is judged that the dust in the dust storage container (60) is almost discharged and "the dust carrying operation" is finished. Thereafter, "the dust removing operation" or "the brush cleaning operation" is again started.

In the filter cleaning operation of the present embodiment, "the dust discharging operation" is performed on a specified condition. In other words, in "the dust carrying operation", the light emitting diode LED (72) is turned on after the dumper (82) is opened and the luminous intensity thereof is detected. If the luminous intensity is lower than a specified value, it is judged that the dust in the dust storage container (60) is not carried by the air blown off from the indoor fan (21), that is, the dust is clogged in a carrying passage from the dust storage container (60) to the dust capturing box (90) or a large amount of dust is captured in the dust capturing box (90). Then, the light emitting diode LED (16) of the decorative panel (11) is lighted to inform the user of that effect and "the dust discharging operation" to be described below is performed according to a remote control operation or the like. In this regard, this kind of operation of detecting the luminous intensity of the light emitting diode LED (72) in association with the motion of the dumper (82) (hereinafter also referred to as "the operation of detecting the dust capturing box being full or the carrying duct being clogged") is performed periodically, for example, once a week.

In "the dust discharging operation", as in the case of "the dust carrying operation" described above, the rotary brush (51) is stopped in the state shown in FIG. 11A and the air filter (30) is set in the stop state. Moreover, the dumper (82) of the dumper box (81) is set in the closed state (state shown in FIG. 14C).

In the state, a suction operation is performed in a state where the user inserts the nozzle of the cleaner into the nozzle insertion part (110) of the decorative panel (11). With this suction operation, the dust in the dust capturing box (90) is sucked into the cleaner through the carrying duct (88), the dust storage container (60), the dumper box (81), the suction duct (87), and the nozzle insertion part (110). At that time, the dust left in the dust storage container (60) is also sucked into the cleaner through the suction duct (87). As a result, the dust in the dust capturing box (90) and the dust storage container (60) is discharged to the outside of the indoor unit (3).

In this regard, as for the operation of detecting the dust capturing box being full or the carrying duct being clogged, when it is once judged that the luminous intensity is smaller than the specified value, the operation is performed periodically at specified intervals until the carrying duct is released from being clogged by the dust and the amount of dust in the dust capturing box (90) is deceased by the dust discharging operation, that is, the luminous intensity of the light emitting diode LED (72) becomes a specified value or more, whereas when the luminous intensity becomes the specified value or more, the LED (16) of the decorative panel (11) is turned off. Thereafter, the normal operation of detecting the dust capturing box being full or the carrying duct being clogged is performed, for example, once a week.

Advantages of the Embodiment

As described above, in this embodiment, the suction duct (87) connected to the nozzle insertion part (110) into which the nozzle (150) of the cleaner is inserted is connected to the dumper box (81) joined to the dust storage container (60) of the dust removing means (50), and the carrying duct (88) connected to the dust capturing box (90) is connected to the dust storage container (60) on the side opposite to the side to which the suction duct (87) is connected. Thus, when the suction operation is performed by the nozzle (150) of the cleaner, not only the dust in the dust capturing box (90) but also the dust in the dust storage container (60) can be recovered, that is, the dust can be recovered efficiently.

Moreover, since the dust capturing box (90) is provided, the dust removed from the air filter (30) by the dust removing means (50) can be captured in the dust capturing box (90), which can reduce the frequency at which the dust is recovered.

Further, the introduction duct (86) for flowing air blown off from the indoor fan (21) is connected to the dumper box (81) on the side opposite to the side where the carrying duct (88) connected to the dust capturing box (90) is connected, so that the dust in the dust storage container (60) joined to the dumper box (81) can be captured in the dust capturing box (90) through the carrying duct (88) by the air blown off from the indoor fan (21). Thus, with the construction, the dust can be carried reliably.

Still further, in the dumper box (81), the dumper (82) for switching the flow channel of air is provided between the position where the introduction duct (86) is connected and the position where the suction duct (87) is connected. Thus, the flow channel of air can be switched between the carrying channel, which introduces the air blown off from the indoor fan (21) into the dumper box (81) and the dust storage container (60) through the introduction duct (86) to carry the dust to the dust capturing box (90), and the suction channel, which sucks the dust in the dust capturing box (90) through the suction duct (87) by the nozzle (150) of the cleaner, by the action of switching the dumper (82). Specifically, the dumper (82) is constructed in the following manner: when the air blown off from the indoor fan (21) is introduced into dumper box (81) and the dust storage container (60), the dumper (82) is opened; whereas when the dust in the dust capturing box (90) is recovered by the nozzle (150) of the cleaner, the dumper (82) is closed to prevent the air blown off from the indoor fan (21) from being introduced into them. Therefore, the dumper (82) can prevent the recovering operation from being inhibited by the air blown off from the indoor fan (21) at the time of recovering the dust.

Still further, the connection pipe (87*a*) of the suction duct (87) is constructed in such a way as to turn around the axis of the connection portion with respect to the dumper box (81). Thus, this construction can improve the degree of freedom of the layout of the suction duct (87) with respect to the dumper box (81).

Still further, the nozzle insertion part (110) is also constructed in such a way that the upper cover (116) can be turned with respect to the lower cover (117). Thus, this construction can improve the degree of freedom of the layout of the suction duct (87) connected to the upper cover (116). Therefore, even if the positional relationship between the dumper box (81) and the nozzle insertion part (110) is changed, the dumper box (81) and the nozzle insertion part (110) can be reliably connected to each other and both can be connected at the shortest way. Thus, even if the direction of slit of the slit part (12*a*) of the suction grill (12) is changed, the dumper box (81) and the nozzle insertion part (110) can be reliably connected to each other in response to the change in the direction of slit. This can improve the degree of freedom of the layout of the direction of slit in the suction grill (12).

Other Embodiments

The embodiment may be constructed in the following way.

In the embodiment, the indoor unit (3) is divided into three parts of the main unit (10), the cleaning unit (100), and the decorative panel (11). However, the construction of the indoor unit (3) is not limited to this, that is, the indoor unit (3) may be constructed in such a way that the constituent parts of the main unit (10) and the cleaning unit (100) are arranged in one casing and that its indoor side is covered with the decorative panel (11).

Moreover, in the embodiment, the dust removed from the air filter (30) is captured in the dust capturing box (90). However, the construction of captured the dust is not limited to this but any construction such as a bag can be employed if the construction can capture dust.

Further, in the embodiment, the dust capturing box (90) is provided in the cleaning unit (100). However, the construction is not limited to this but the dust capturing box (90) may be provided separately from the indoor unit (3).

Still further, in the embodiment, the air blown off from the indoor fan (21) is used as means for carrying dust from the dust storage container (60) to the dust capturing box (90). However, the construction of carrying dust is not limited to this but any construction can be employed if the construction can carry dust, and a dedicated fan may be provided.

Still further, in the embodiment, the air filter (30) is formed in a circular shape. However, the shape of the air filter (30) is not limited to the circular shape but may be formed in, for example, a rectangular shape. In this case, the air filter (30) and the rotary brush (51) are moved straightly relatively. Even in this case, when the dust removing means (50) and the dumper box (81) are turnably constructed, the dust removing means (50) and the dumper box (81) can be easily moved to a position where they do not overlap the air filter (30) when viewed in a plan view.

Still further, the embodiment is constructed in the following manner: the introduction duct (86) and the partition plate (25) are provided with the protruding parts (86*i*), (25*b*), respectively; and when the introduction duct (86) is turned, the introduction duct (86) can be moved up and down with respect to the partition plate (25). However, the construction of the introduction duct (86) is not limited to this but any construction can be employed if the construction can move up and down the introduction duct (86), for example, a threaded part may be formed on the outer peripheral surface of the introduction duct (86). In this regard, of course, if the maintenance position of the dust removing means (50) is a position where the dust removing means (50) does not overlap the air filter (30) when viewed in a plan view, it is not necessary to employ the construction of moving up and down the introduction duct (86) as described above.

Still further, in the embodiment, the dumper (82) is provided as a channel switching device in the dumper box (81). However, the construction of the channel switching device is not limited to this but any construction can be employed if the construction can switch a channel.

INDUSTRIAL APPLICABILITY

As described above, the present invention is especially useful for an indoor unit of an air conditioner having an air filter provided on the suction side of an indoor fan.

DESCRIPTION OF REFERENCE CHARACTERS

1 Air Conditioner
3 Indoor Unit
10 Main Unit
11 Decorative Panel (Indoor Side Panel)
18 Main Casing (Casing)
21 Indoor Fan
22 Indoor Heat Exchanger
30 Air Filter
50 Dust Removing Means
51 Rotary Brush (Dust Removing Part)
52 Cleaning Brush (Dust Removing Part)
60 Dust Storage Container (Storage Container)
68*a* Slit Part
80 Dust Carrying Device
81 Dumper Box (Storage Container, Connection Passage Part)
82 Dumper (Channel Switching Device)
86 Introduction Duct
87 Duct for Suction (Suction Duct)
88 Carrying Duct
89 Blown-off Air Passage
90 Dust capturing box (Dust Capturing Part)
95 Suction Passage
96 Dust Carrying Passage
100 Cleaning Unit
101 Chamber Casing (Casing)
110 Nozzle Insertion Part
116 Upper Cover (Upper Cover Member)
117 Lower Cover (Lower Cover Member)
121 Nozzle Connection Part
150 Nozzle of Cleaner

The invention claimed is:

1. An indoor unit of an air conditioner in which an indoor heat exchanger, an indoor fan for blowing off air sucked from inside a room to the inside of the room, and an air filter provided on a suction side of the indoor fan are provided in casings, the indoor unit comprising:

dust removing parts for removing dust captured by the air filter;

storage containers having the dust removing parts stored therein;

a nozzle connection part on which a nozzle of a cleaner contacts;

a suction passage for making the storage containers directly communicate with the nozzle connection part;

a dust capturing part for capturing the dust in the storage containers; and a dust carrying device for carrying the dust in the storage containers to the dust capturing part, wherein the dust carrying device is provided with a dust carrying passage for making the storage containers communicate with the dust capturing part, and the dust carrying passage is provided to communicate with the storage containers at an end part opposite to a communication part in which the suction passage communicates with the storage containers.

2. The indoor unit of an air conditioner of claim 1, wherein the dust carrying device is constructed in such a way as to carry the dust to the dust capturing part by utilizing of air blown off from the indoor fan and is provided with a blown-off air passage for making a blowoff side of the indoor fan to communicate with the storage containers, the blown-off air passage being provided in such a way as to communicate with the storage containers at an end part opposite to a communication part in which the dust carrying passage communicates with the storage containers.

3. The indoor unit of an air conditioner of claim 2, further comprising:

a channel switching device capable of switching a flow channel of air in the storage containers between a carrying channel in which air flows from the blown-off air passage to the dust carrying passage and a suction channel in which air flows from the dust carrying passage to the suction passage.

4. The indoor unit of an air conditioner of claim 3, wherein the storage containers have a connection passage part to which the blown-off air passage and the suction passage are connected, and the channel switching device is provided between a communication part in which the blown-off air passage communicates with the connection passage part and a communication part in which the suction passage communicates with the connection passage part.

5. The indoor unit of an air conditioner of claim 1, wherein a suction duct constructing the suction passage is connected to the storage containers rotatably about an axis of a connection portion in which the suction duct is connected to the storage containers.

6. The indoor unit of an air conditioner of claim 1, wherein an indoor side panel for covering indoor sides of the casings is provided with a nozzle insertion part into which the nozzle of the cleaner can be inserted, and the nozzle connection part is provided in the nozzle insertion part.

7. The indoor unit of an air conditioner of claim 6, wherein the nozzle insertion part is provided with an upper cover member and a lower cover member for covering the nozzle connection part the upper cover member having the suction passage connected thereto and being configured to turn with respect to the lower cover member.

* * * * *